US008657394B2

(12) United States Patent
Katoh et al.

(10) Patent No.: US 8,657,394 B2
(45) Date of Patent: Feb. 25, 2014

(54) IMAGE FORMING APPARATUS

(75) Inventors: Tomomi Katoh, Kanagawa (JP); Kazuo Haida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 168 days.

(21) Appl. No.: 13/060,454

(22) PCT Filed: Aug. 13, 2009

(86) PCT No.: PCT/JP2009/064536

§ 371 (c)(1),
(2), (4) Date: Feb. 24, 2011

(87) PCT Pub. No.: WO2010/026880

PCT Pub. Date: Mar. 11, 2010

(65) Prior Publication Data

US 2011/0164078 A1 Jul. 7, 2011

(30) Foreign Application Priority Data

Sep. 2, 2008 (JP) ..... 2008-225226
Jun. 25, 2009 (JP) ..... 2009-151505

(51) Int. Cl.
*B41J 29/38* (2006.01)
*B41J 2/17* (2006.01)
*B41J 2/175* (2006.01)

(52) U.S. Cl.
USPC ..... 347/6; 347/84; 347/85

(58) Field of Classification Search
USPC ..... 347/20, 6–7, 84–86, 89
See application file for complete search history.

(56) References Cited

U.S. PATENT DOCUMENTS

| | | | | |
|---|---|---|---|---|
| 5,446,486 | A | 8/1995 | Reis | |
| 6,406,112 | B1 * | 6/2002 | Oikawa | 347/9 |
| 6,682,185 | B2 | 1/2004 | Hashimoto et al. | |
| 6,913,348 | B2 | 7/2005 | Hashimoto et al. | |
| 7,156,507 | B2 | 1/2007 | Aruga et al. | |
| 7,278,696 | B2 * | 10/2007 | Matsuzaki et al. | 347/4 |

(Continued)

FOREIGN PATENT DOCUMENTS

| | | |
|---|---|---|
| JP | 55121071 | 9/1980 |
| JP | 55121073 | 9/1980 |

(Continued)

OTHER PUBLICATIONS

International Search Report and Written Opinion in PCT/JP2009/064536.

(Continued)

*Primary Examiner* — Jason Uhlenhake
(74) *Attorney, Agent, or Firm* — Cooper & Dunham LLP

(57) ABSTRACT

Disclosed is an image forming apparatus that includes a recording head ejecting a liquid droplet; a liquid tank storing ink to be supplied to the recording head; a first flow path communicated with the recording head and the liquid tank; a liquid feeding unit provided in the first flow path; a second flow path provided parallel to the liquid feeding unit of the first flow path; and a fluid resistance control unit provided in the second flow path. The fluid resistance control unit changes fluid resistance in accordance with the flow rate of a flowing liquid and feeds, when the liquid droplet is ejected from the recording head, the liquid from the liquid tank to the recording head with the liquid feeding unit in a state in which the recording head and the liquid tank are communicated with each other via the second flow path.

15 Claims, 27 Drawing Sheets

(56) References Cited

U.S. PATENT DOCUMENTS

| | | | | |
|---|---|---|---|---|
| 7,325,908 | B2 | 2/2008 | Katoh et al. | |
| 7,364,253 | B2 | 4/2008 | Hashimoto et al. | |
| 2003/0025773 | A1* | 2/2003 | Koizumi et al. | 347/85 |
| 2005/0219282 | A1 | 10/2005 | Kachi | |
| 2006/0132554 | A1* | 6/2006 | Ota et al. | 347/85 |
| 2006/0203034 | A1* | 9/2006 | Uetsuki et al. | 347/33 |
| 2006/0206140 | A1* | 9/2006 | Shaolian et al. | 606/200 |
| 2007/0008356 | A1 | 1/2007 | Katoh | |
| 2007/0291086 | A1* | 12/2007 | Murakami et al. | 347/85 |
| 2008/0158294 | A1 | 7/2008 | Katoh | |
| 2008/0273046 | A1 | 11/2008 | Ishinaga et al. | |
| 2009/0051724 | A1 | 2/2009 | Katoh | |

FOREIGN PATENT DOCUMENTS

| | | |
|---|---|---|
| JP | 60-198253 | 10/1985 |
| JP | 5-504308 | 7/1993 |
| JP | 3606282 | 10/2004 |
| JP | 2004-351845 | 12/2004 |
| JP | 2005-342960 | 12/2005 |
| JP | 2006-159811 | 6/2006 |

OTHER PUBLICATIONS

European Search Report dated Mar. 6, 2013 in corresponding European patent application No. 09 81 1407.7.

* cited by examiner

IMAGE FORMING APPARATUS

TECHNICAL FIELD

The present invention relates to image forming apparatuses and, in particular, to an image forming apparatus having a recording head that ejects liquid droplets.

BACKGROUND ART

As an image forming apparatus such as a printer, a facsimile machine, a copier, a plotter, and a multi-task machine having plural such functions, a known ink jet recording apparatus of a liquid ejection recording type uses a recording head that ejects, for example, ink liquid droplets. The image forming apparatus of this type ejects ink droplets onto a sheet during conveyance from the recording head to perform image formation (used synonymously with recording, printing, and imaging). Examples of the image forming apparatus include a serial-type image forming apparatus in which a recording head ejects liquid droplets to form an image while moving in a main scanning direction and a line-type image forming apparatus using a line-type head in which a recording head ejects liquid droplets to form an image without moving.

Note that in the present invention, an "image forming apparatus" refers to an apparatus (including a simple liquid ejection apparatus) that ejects ink droplets onto a medium such as paper, a thread, a fiber, a fabric, leather, metal, a plastic, glass, wood, and a ceramic so as to perform image formation. Furthermore, "image formation" refers to forming on a medium not only relevant images such as characters and graphics, but also irrelevant images such as random patterns (i.e., an apparatus called a liquid droplet ejection apparatus or a liquid ejection apparatus that merely shoots liquid droplets on a medium). Furthermore, "ink" is not limited to one as generally called ink, but it is used as a generic name of various liquid available for the image formation, such as recording liquid, fixing treatment liquid, a DNA sample, and a patterning material. Furthermore, the material of a "sheet" is not limited to a piece of paper. That is, the sheet refers to ones including an OHP sheet, a fabric, etc., onto which ink droplets are ejected, and it is used as a generic name of one including a medium to be recorded, a recording medium, a recording sheet, a recording paper, etc.

As a liquid ejection head used as a recording head, a piezoelectric-type head is known which increases a pressure and ejects liquid droplets in such a manner that a vibration plate is displaced with a piezoelectric actuator or the like to change a volume in a liquid chamber. Also, a thermal-type head is known which ejects liquid droplets in such a manner that a pressure in a liquid chamber is increased by air foam generated due to heat by a heating element that is provided in the liquid chamber and generates heat upon energization.

In such an image forming apparatus of a liquid ejection type, an improvement in an image formation throughput, i.e., acceleration of an image formation speed has been particularly demanded. The image forming apparatus supplies ink from a high-capacity ink cartridge (main tank) installed in the main body of the image forming apparatus to a sub-tank (including one called a head tank or a buffer tank) arranged above the recording head via a tube. Supply of the ink via the tube in this manner (tube supply method) makes it possible to reduce the size and weight of a carriage part and greatly reduce the size of the apparatus including a structure system and a driving system.

Meanwhile, in the tube supply method, ink to be consumed from the recording head during image formation is supplied from the ink cartridge to the recording head via the tube. However, if a thin tube excellent in flexibility is used, fluid resistance becomes large when the ink flows in the tube. Therefore, supply of the ink may be delayed at the ejection of the ink, which results in an ejection failure. Particularly, in a large-sized machine that performs printing on a wide recording medium, the length of a tube is necessarily long and the fluid resistance of the tube becomes large. Furthermore, when printing is performed at high speed and when high-viscosity ink is ejected, the fluid resistance becomes large. Therefore, short supply of the ink to the recording head occurs.

In order to address these problems, a method disclosed in Patent Document 1 is known. Specifically, ink in an ink cartridge is maintained in a pressurized state, and a differential pressure regulating valve provided on the upstream side of a head for supplying the ink is used to supply the ink when a negative pressure in a sub-tank becomes greater than a predetermined pressure.

In addition, a method disclosed in Patent Document 2 is known in which ink is fed by a pump to a negative pressure chamber that receives a negative pressure with a spring arranged above a head to positively control a ink supply pressure. Furthermore, a method disclosed in Patent Document 3 is known in which a pump is used to positively control a pressure without a negative chamber.

In addition, a method disclosed in Patent Document 4 is known in which an ink circulation system is connected to a recording head having two ink supply ports to control the pressure of the head in accordance with the flow rate of a circulation pump.

On the other hand, as a method for obtaining a negative pressure with a simple configuration, an ink cartridge in communication with air is connected to a recording head via a tube so that the ink cartridge is arranged beneath the recording head. With this arrangement, a water head difference is generated to obtain the negative pressure.

In spite of its simple configuration, this method can provide a more stable negative pressure than a method for applying a pressure at all times with a negative pressure geared valve or a method for feeding ink with a negative pressure chamber. However, this method using a water head causes a pressure loss due to resistance of a tube as described above.

As a technology for solving this pressure loss in the ink supply system that obtains a negative pressure using a water head, Patent Document 5 discloses a configuration in which a pump is provided in a tube connecting a head to an ink cartridge, a bypass is provided between the upstream side and the downstream side of the pump, and a valve is provided in the bypass. An opening degree of the valve provided in the bypass is appropriately controlled according to printing to maintain a desired pressure.

Patent Document 1: JP-B2-3606282
Patent Document 2: JP-A-2005-342960
Patent Document 3: JP-A-5-504308
Patent Document 4: JP-A-2006-159811
Patent Document 5: JP-A-2004-351845

The technology disclosed in Patent Document 1 solves the problem of the short supply of the ink described above, but its mechanism for controlling a negative pressure is complicated and high sealing performance of a negative pressure geared valve is required. In addition, since a pressure is applied at all times, high airtightness of all connection parts in an ink supplying path is required. In the event of a failure, the ink may be spouted from the ink supplying path.

Furthermore, since a pressure is positively controlled by the pump in the technologies disclosed in Patent Documents 2 through 4, a feeding amount by the pump must be correctly controlled in accordance with a consumption amount of the ink. Therefore, feedback control or the like using the pressure of the negative pressure chamber is required. In addition, when the technologies are applied to an image forming apparatus using, for example, plural different colors of ink, the pump must be controlled for each color of the ink, which results in complicated control of the apparatus and an increased size of the apparatus.

Similarly, when the technology disclosed in Patent Document 5 is applied to the image forming apparatus using plural different colors of ink, the pump must be controlled for each color of the ink, which results in an increased size of the apparatus.

DISCLOSURE OF INVENTION

The present invention has been made in light of the above problems and may maintain a stable negative pressure with a simple configuration and prevent short supply of ink even under a high speed, the elongation of a tube, and an increased viscosity of the ink when plural different types of the ink are supplied by an ink supply method using the tube.

According to an aspect of the present invention, there is provided an image forming apparatus including a recording head that ejects a liquid droplet; a liquid tank that stores ink to be supplied to the recording head; a first flow path that is communicated with the recording head and the liquid tank; a liquid feeding unit that is provided in the first flow path; a second flow path that is provided parallel to the liquid feeding unit of the first flow path; and a fluid resistance control unit that is provided in the second flow path. The fluid resistance control unit changes fluid resistance in accordance with the flow rate of a flowing liquid and feeds, when the liquid droplet is ejected from the recording head, the liquid from the liquid tank to the recording head with the liquid feeding unit in a state in which the recording head and the liquid tank are communicated with each other via the second flow path.

With this configuration, an appropriate assist pressure is automatically adjusted and applied to the recording head in accordance with an amount of the liquid droplet ejected from the recording head. As a result, short refill of the ink due to the elongation of a tube member, an increase in a flow rate of the ink to be ejected, high viscosity of the ink to be ejected, or the like can be prevented.

BEST MODE FOR CARRYING OUT THE INVENTION

Figure 1:
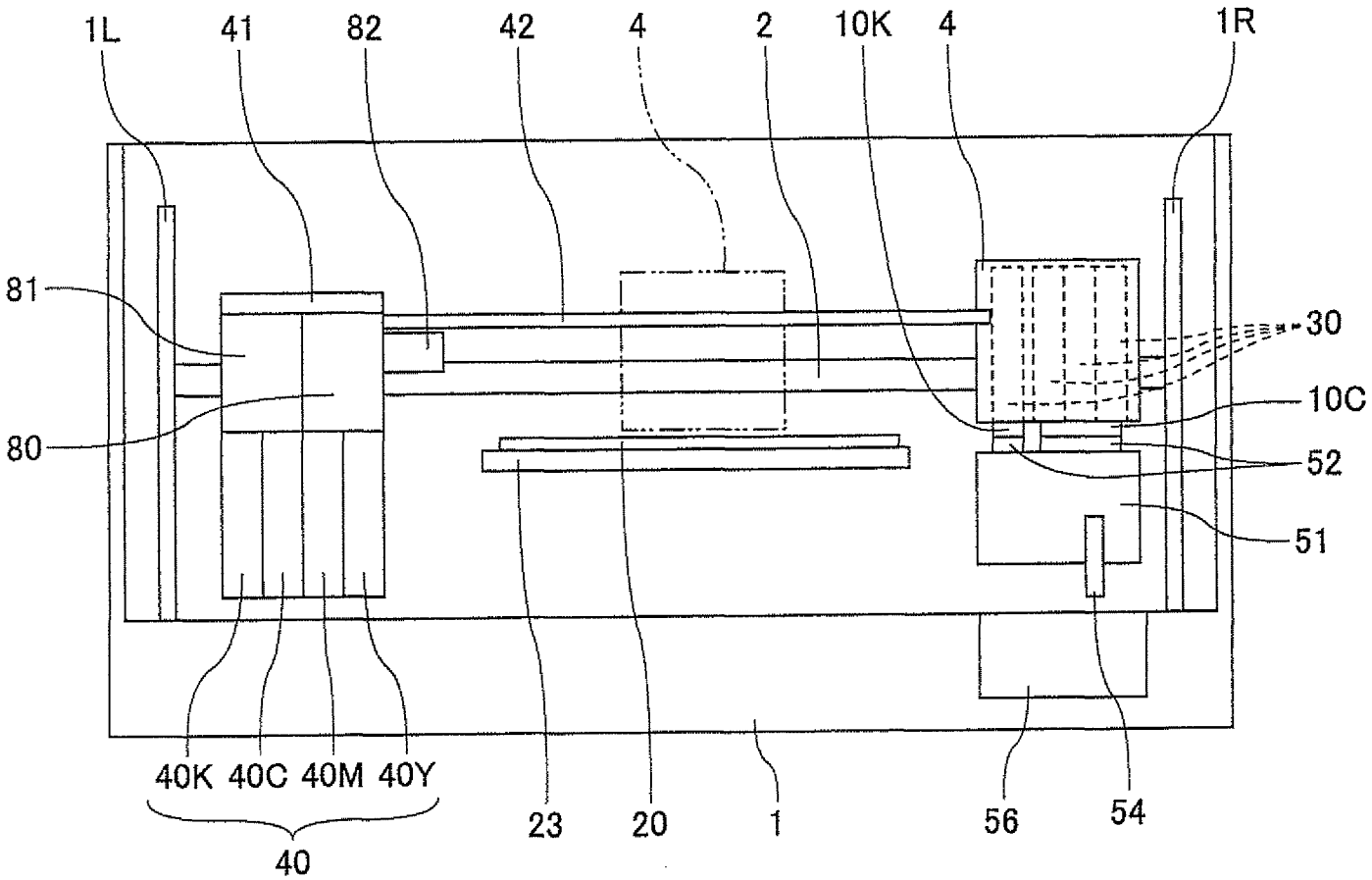
FIG. 1 is a schematic front explanatory view showing an example of an ink jet recording apparatus serving as an image forming apparatus according to embodiments of the present invention.
Figure 2:
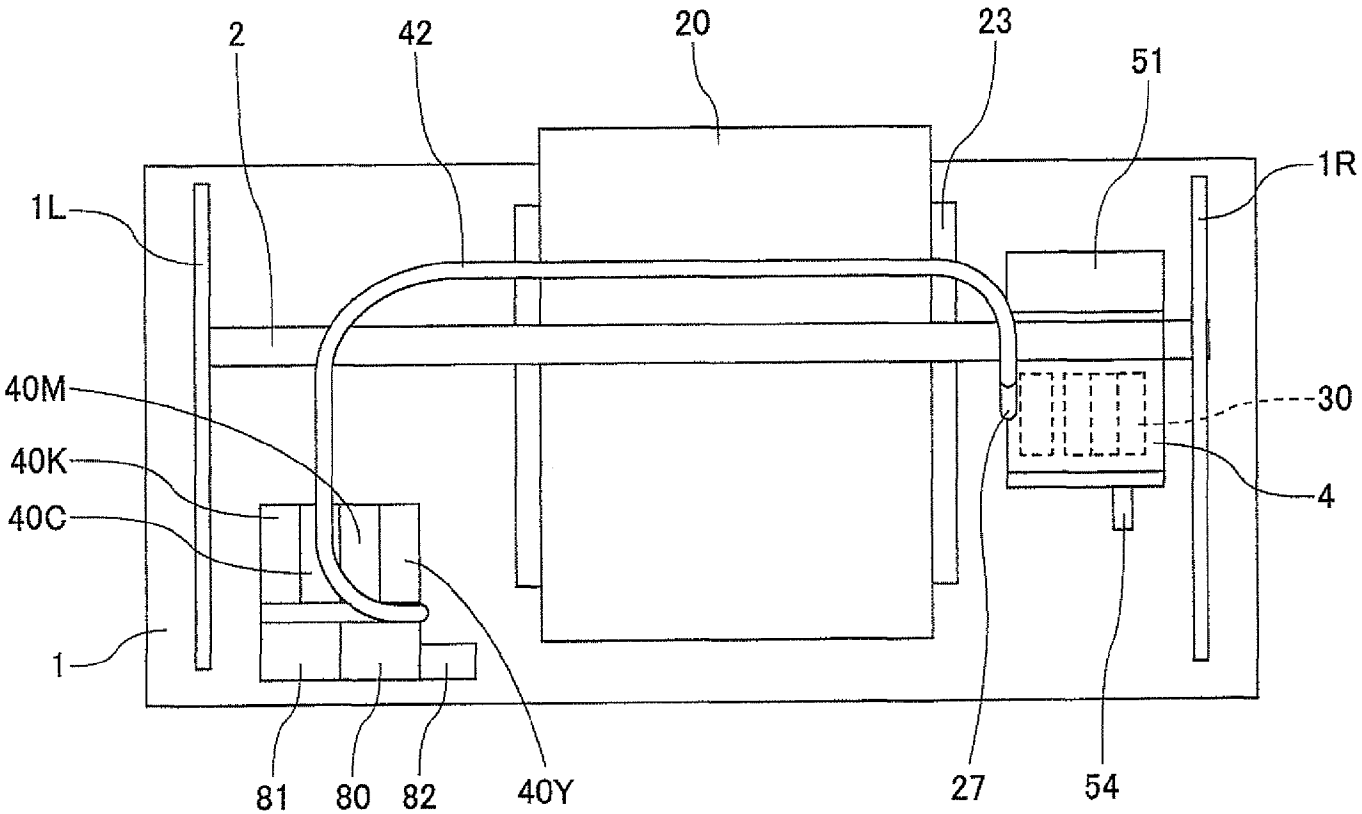
FIG. 2 is a schematic plan explanatory view of the ink jet recording apparatus.
Figure 3:
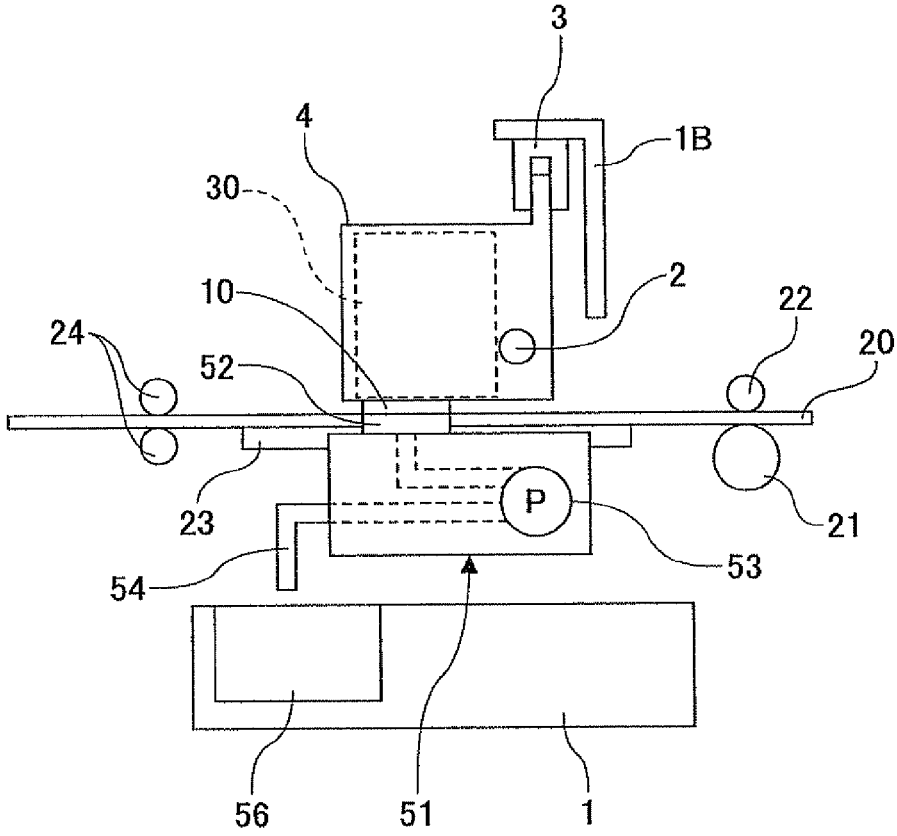
FIG. 3 is a schematic side explanatory view of the ink jet recording apparatus.

Embodiments of the present invention are described below with reference to the accompanying drawings. With reference to FIGS. 1 through 3, a description is now made of an example of an ink jet recording apparatus as an image forming apparatus to which the embodiments of the present invention are applied. Note that FIG. 1 is a schematic front explanatory view of the ink jet recording apparatus, FIG. 2 is a schematic plan explanatory view of the ink jet recording apparatus, and FIG. 3 is a schematic side explanatory view of the ink jet recording apparatus.

In this ink jet recording apparatus, a carriage 4 is slidably supported in a main scanning direction (the longitudinal direction of a guide rod) by a guide rod 2 serving as a guide member laterally bridged between right and left side plates 1L and 1R extending from a main body frame 1 and by a guide rail 3 attached to a rear frame 1B laterally bridged to the main body frame 1. In addition, the carriage 4 is moved and scanned in the longitudinal direction (main scanning direction) of the guide rod 2 by a main scanning motor and a timing belt not shown.

A recording head 10K that ejects ink droplets of black (K) and a recording head 10C that ejects ink droplets of cyan (C), magenta (M), and yellow (Y) are mounted on the carriage 4. In the recording head 10, plural ink ejection ports (nozzles) are arranged in a direction orthogonal to the main scanning direction, and an ink droplet ejection direction is directed downward. The recording head 10C has at least three nozzle arrays from which at least the separate ink droplets of C, M, and Y are ejected. Note that in the following description, each of the nozzle arrays corresponding to the respective colors of K of the recording head 10K and C, M, and Y of the recording head 10C is referred to as the "recording head 10" unless otherwise specified.

Figure 4:
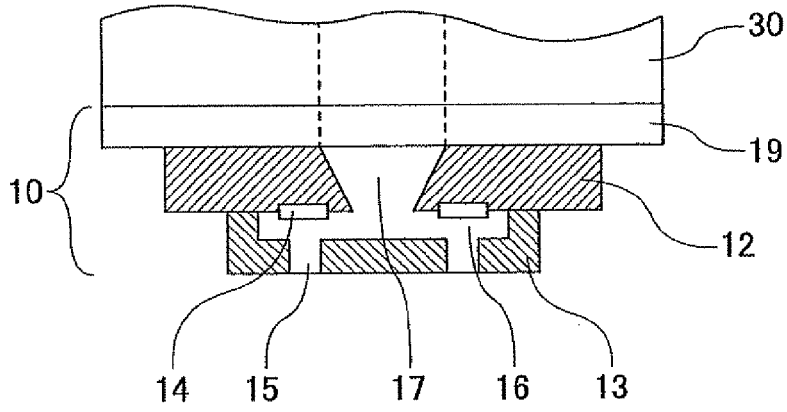
FIG. 4 is a substantial-part enlargement explanatory view for explaining a recording head of the ink jet recording apparatus.

As shown in FIG. 4, the recording head 10 is composed of a heating element substrate 12 and a liquid chamber forming member 13 and ejects ink as liquid droplets successively supplied from a flow path formed in a head base member 19 to a common flow path 17 and a liquid chamber (separate flow path) 16. The recording head 10 is of a thermal type in which an ejection pressure is generated by film boiling of the ink when a heating element 14 is driven. Furthermore, the recording head 10 has a side shooter system in which an ink flow direction to an ejection energy operation part (heating element part) is made perpendicular to the opening central axes of nozzles 15 inside the liquid chamber 16.

Note that as the recording head for generating an ejection pressure, various recording heads such as a recording head that deforms a vibration plate with piezoelectric elements and a recording head that deforms a vibration plate with an electrostatic force are available. Either type may be applied to the image forming apparatus according to the embodiments of the present invention.

Furthermore, another thermal type recording head uses an edge shooter system in which an ejection direction is different. However, in this edge shooter system, a so-called cavitation phenomenon occurs in which the heating element 14 is gradually broken by an impact when air foam disappears. Conversely, in the above side shooter system, air foam grows. When the air foam reaches the nozzles 15, it communicates with air, which in turn prevents a shrinkage of the air foam due to reduction in temperature. Therefore, the side shooter system has the advantage that the service life of the recording head is long. In addition, the side shooter system has the structural advantages that energy from the heating element 14 can be efficiently converted into a kinetic energy for forming and ejecting ink droplets and a meniscus can be quickly reset with supply of ink. From the reasons above, the ink jet recording apparatus according to the embodiments of the present invention uses the side shooter system.

Below the carriage 4, a sheet 20 on which an image is formed by the recording head 10 is conveyed in a direction (sub-scanning direction) perpendicular to the main scanning direction. As shown in FIG. 3, the sheet 20 is conveyed to an image forming region (printing part) where the recording head 10 performs a recording operation in a state of being held by a conveyance roller 21 and a pressing roller 22. Then, the sheet 20 is conveyed to an imaging guide member 23. Finally, the sheet 20 is conveyed in a sheet discharging direction by a pair of sheet discharging rollers 24.

At this time, scanning by the carriage 4 in the main scanning direction is synchronized with an ink ejection from the recording head 10 at appropriate timing based on image data, so that an image corresponding to one band is formed on the sheet 20. After completion of forming the image corresponding to one band, the sheet 20 is conveyed in the sub-scanning direction by a predetermined amount, and then the same recording operation is performed on the sheet 20. With the repetition of the above operations, image formation corresponding to one page is performed.

On the other hand, a sub-tank (i.e., a buffer tank or a head tank) 30, in which an ink chamber for temporarily storing the ink to be ejected is formed, is integrally connected to the upper part of the recording head 10. Here, the state expressed as "integrally connected" also includes a situation in which the recording head 10 and the sub-tank 30 are connected to each other via a tube, a pipe, or the like, indicating that both the recording head 10 and the sub-tank 30 are mounted on the carriage 4.

The respective colors of the ink are supplied from an ink cartridge (main tank) 40 serving as a liquid tank storing the respective colors of the ink detachably attached to a cartridge holder 41 provided on the side of one end of an apparatus main body in the main scanning direction, to the sub-tank 30 via a liquid (ink) supplying tube 42 serving as a tube member constituting a part of a first flow path.

Furthermore, a maintenance and restoration mechanism 51 that maintains and restores the recording head 10 is arranged on the side of the other end of the apparatus main body in the main scanning direction. The maintenance and restoration mechanism 51 is composed of a cap member 52 that caps the nozzle surface of the recording head 10, a suction pump 53 that suctions the ink inside the cap member 52, a discharging path through which waste liquid of the ink suctioned by the suction pump 53 is discharged, and the like. The waste liquid discharged from the discharging path 54 is discharged to a waste liquid tank 56 arranged on the side of a main body frame 1.

Figure 5:
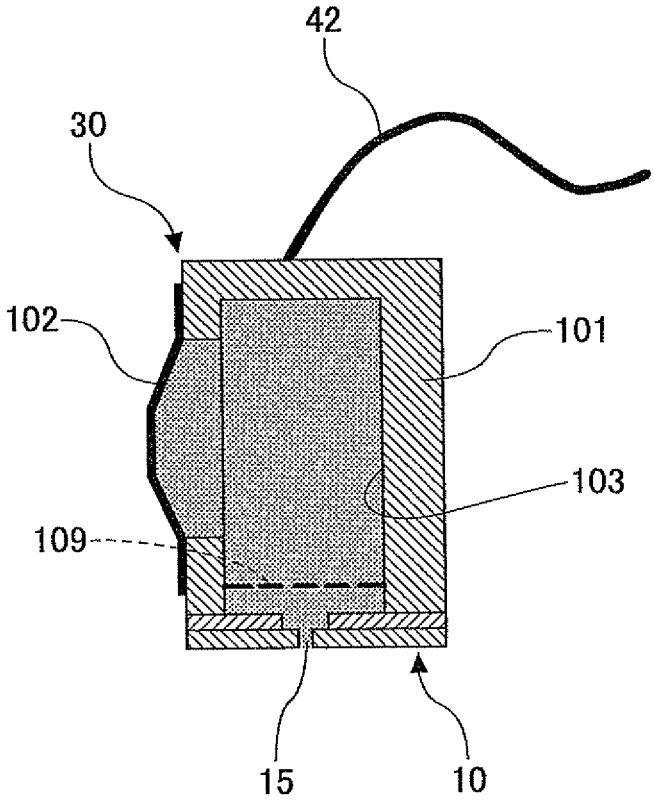
FIG. 5 is a cross-sectional explanatory view of a sub-tank of an ink supplying system according to a first embodiment of the present invention.
Figure 6:
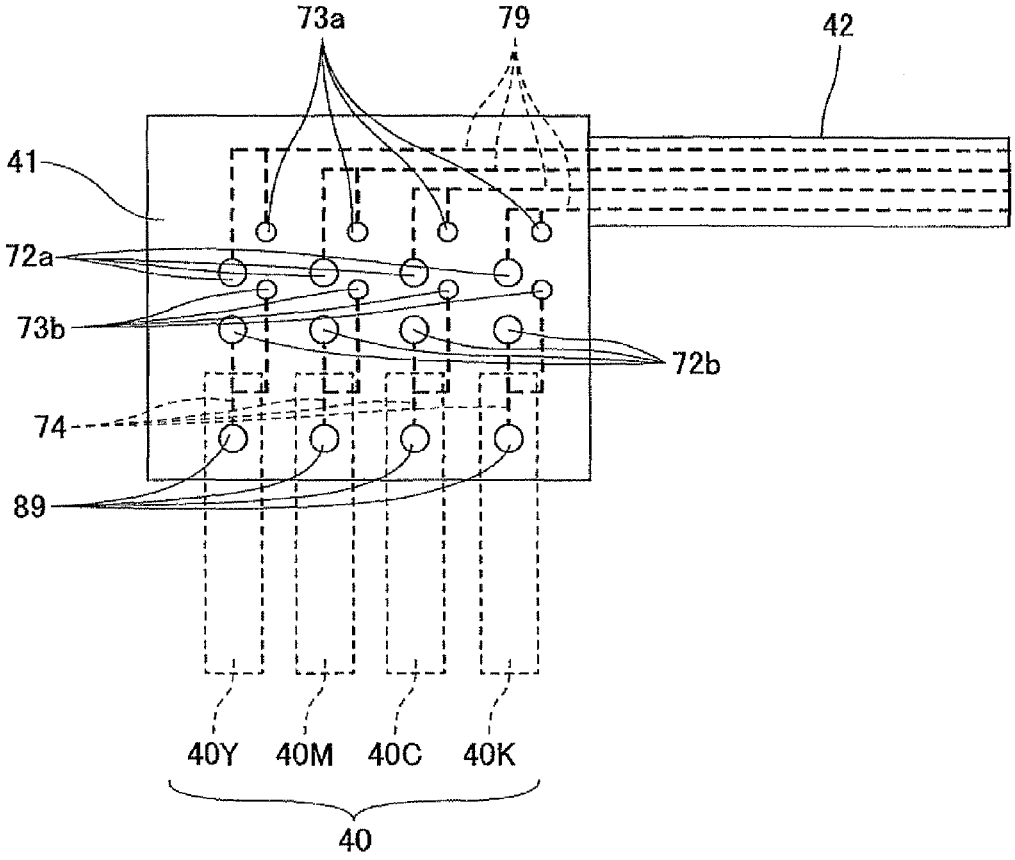
FIG. 6 is an explanatory view of a cartridge holder of the ink supplying system.
Figure 7:
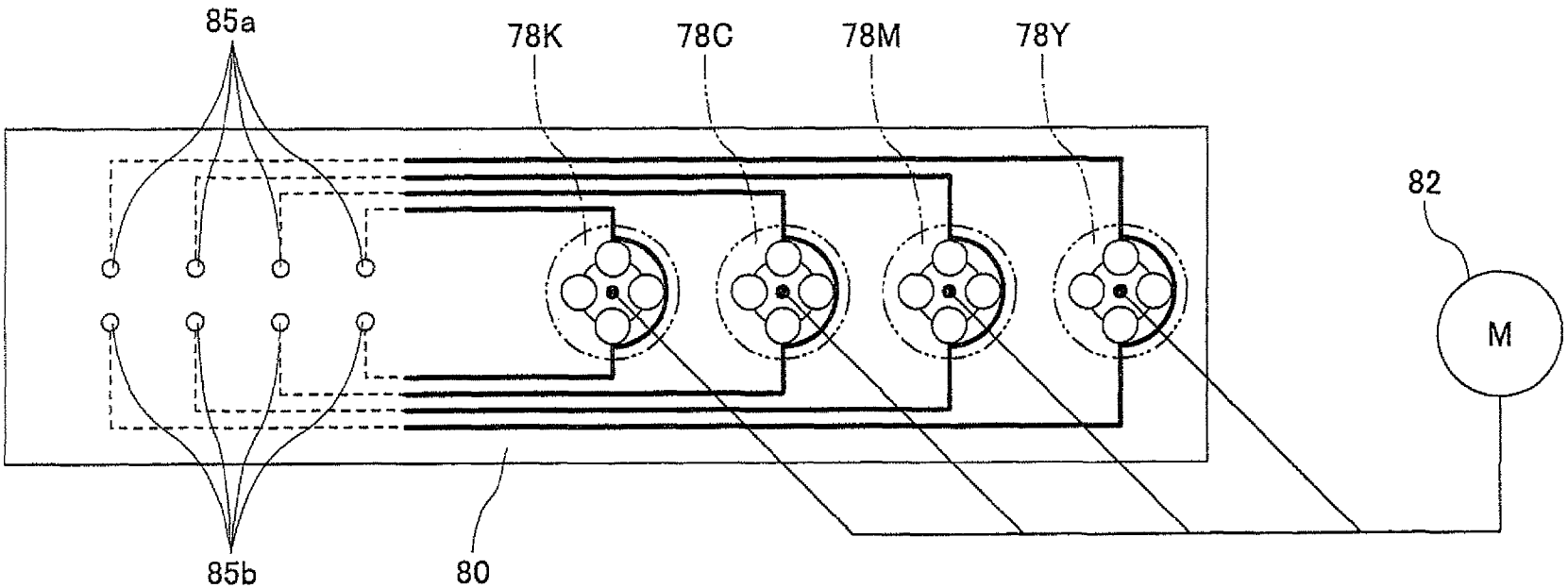
FIG. 7 is an explanatory view of a pump unit of the ink supplying system.
Figure 8:
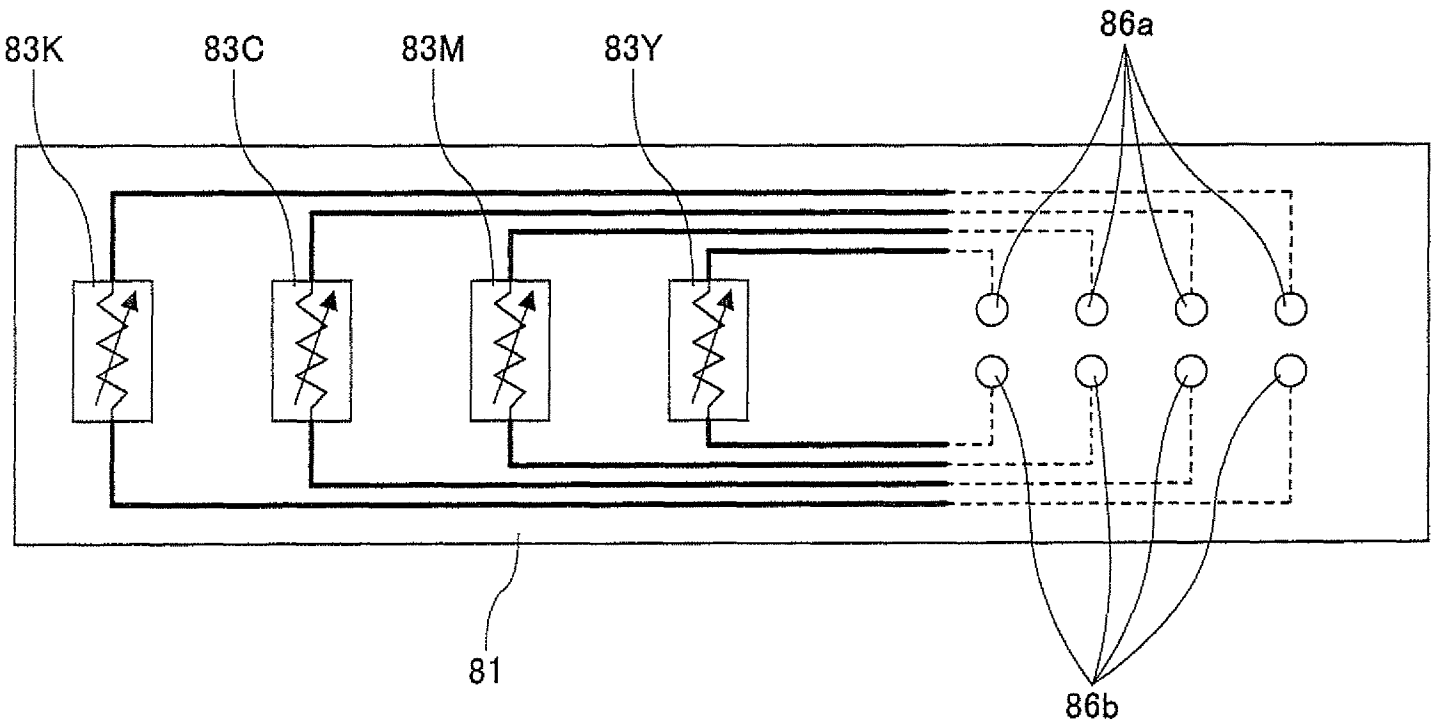
FIG. 8 is an explanatory view of a pressure control unit of the ink supplying system.
Figure 9B:
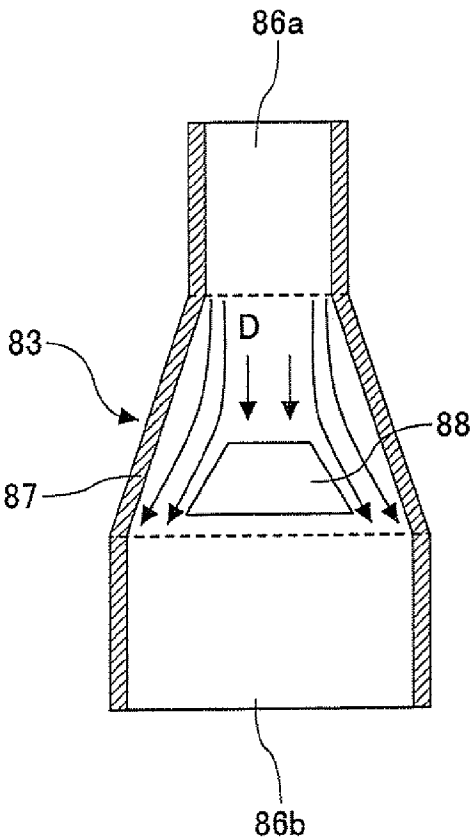
FIGS. 9A and 9B are explanatory views showing an example of a flow path resistance variable unit of the ink supplying system.
Figure 9A:
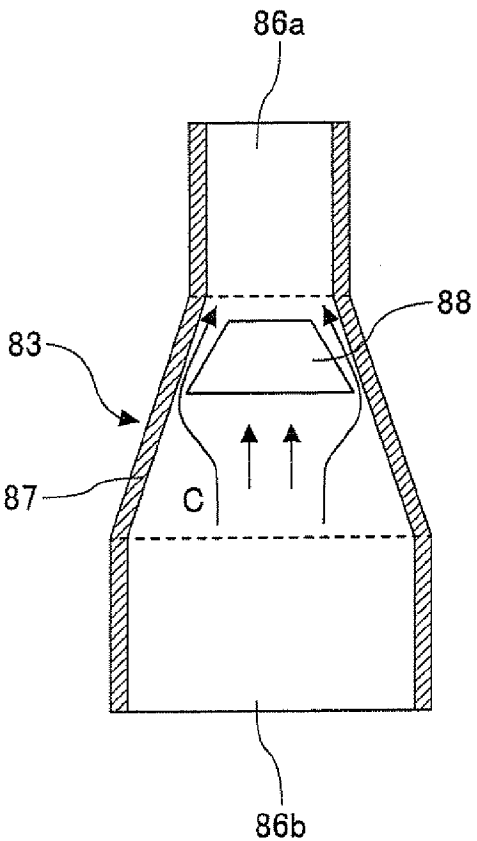
Figure 10B:
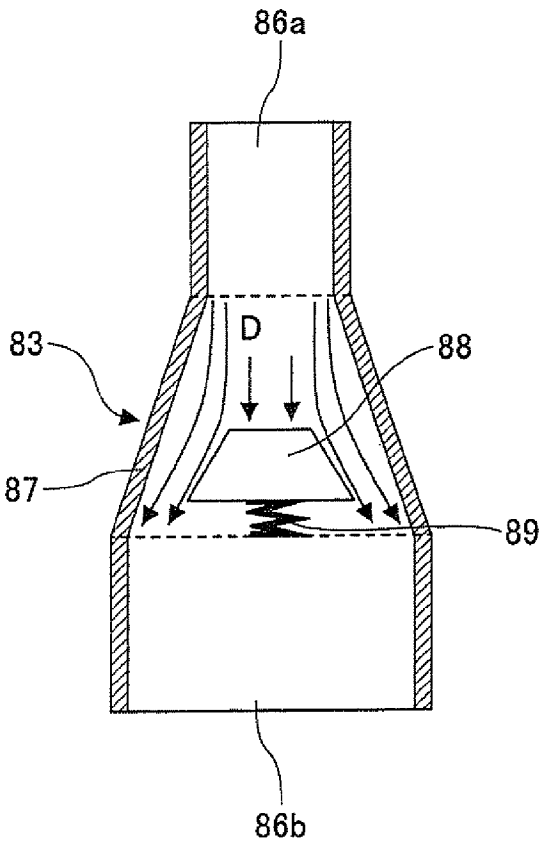
FIGS. 10A and 10B are explanatory views showing another example of the flow path resistance variable unit of the ink supplying system.
Figure 10A:
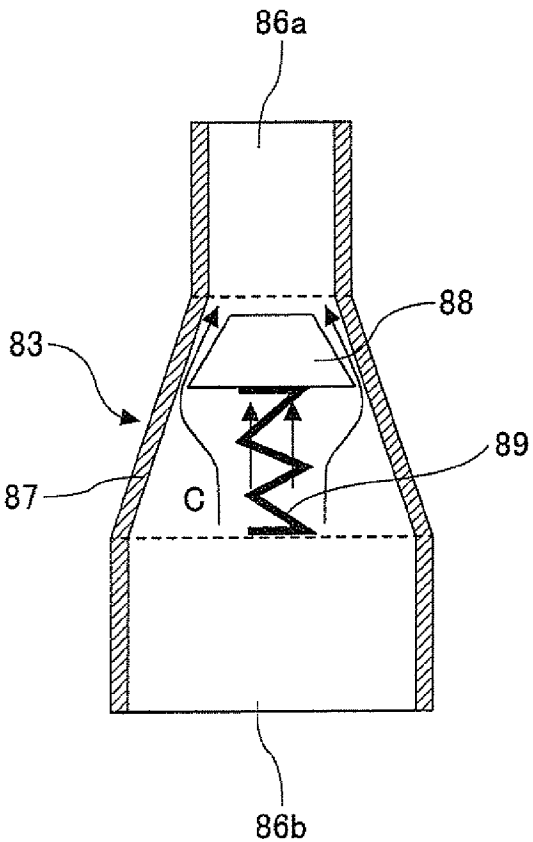

Next, with reference to FIGS. 5 through 10A and 10B, a description is made of an ink supplying system according to a first embodiment of the present invention applied to the ink jet recording apparatus. Note that FIG. 5 is a cross-sectional explanatory view of the sub-tank of the ink supplying system, FIG. 6 is an explanatory view of the cartridge holder of the ink supplying system, FIG. 7 is an explanatory view of the pump unit of the ink supplying system, FIG. 8 is an explanatory view of a pressure control unit of the ink supplying system, and FIGS. 9 and 10A and 10B are explanatory views showing different examples of a flow path resistance variable unit.

First, the sub-tank 30 has a flexible rubber member 102 formed into an outwardly-directed convex shape at the opening of a part of a tank case 101 constituting an ink chamber 103. Inside the ink chamber 103, a filter 109 is provided in the vicinity of a part to which the recording head 10 is connected. Furthermore, the sub-tank 30 supplies the ink from which foreign matters are removed by filtration to the recording head 10.

The sub-tank 30 is connected to one end of an ink supplying tube 42. The other end of the ink supplying tube 42 is connected to the cartridge holder 41 installed in the main body of the image forming apparatus as shown in FIGS. 1 and 2.

The cartridge holder 41 is connected to the ink cartridge 40, a pump unit 80 serving as a liquid feeding unit, and a pressure control unit 81 serving as a fluid resistance control unit.

As shown in FIG. 6, two branch flow paths 79 and 74 corresponding to the respective colors of the ink are formed inside the cartridge holder 41. The branch flow paths 79 and 74 are branched into two paths and have pump connection ports 73*a* and 73*b* communicated with the pump unit 80 and pressure control ports 72*a* and 72*b* communicated with the pressure control unit 81.

As shown in FIG. 7, the pump unit 80 has ports 85*a* and 85*b* communicated with the pump connection parts 73*a* and 73*b*, respectively, of the cartridge holder 41 and has a pump 78 communicated with the ports 85*a* and 85*b*. As the pump 78, various pumps such as a tubing pump, a diagram pump, and a gear pump may be used. In the pump unit 80 shown in FIG. 7, four pumps 78K, 78C, 78M, and 78Y are provided corresponding to the four colors of the ink. The four pumps 78K, 78C, 78M, and 78Y are driven in conjunction with a motor 82 serving as a common driving unit.

As shown in FIG. 8, the pressure control unit 81 has ports 86*a* and 86*b* communicated with the pressure control ports 72*a* and 72*b*, respectively, of the cartridge holder 41 and has a flow path resistance variable unit 83 communicated with the ports 86*a* and 86*b*.

The flow path resistance variable unit 83 has the characteristic that fluid resistance is changed according to the flow direction and the flow rate of the liquid flowing inside the flow path resistance variable unit 83. As shown in FIGS. 9A and 9B, the flow path resistance variable unit 83 is composed of a tapered pipe 87 and a valve body 88 movably accommodated in the tapered pipe 87. The valve body 88 is formed of a material whose specific gravity is lower than that of the ink flowing inside the tapered pipe 87, or it is formed such that its interior is hollow.

As shown in FIG. 9A, in the flow path resistance variable unit 83, the valve body 88 is positioned on the side of the port 86*a* due to the characteristics of the buoyancy and the flow when the ink does not flow and when the ink flows in the direction C as indicated by arrows C (when the ink flows in the direction from the ink cartridge 40 to the recording head 10). With this arrangement, a flow path formed by a gap between the tapered pipe 87 and the valve body 88 is maintained narrow, and the fluid resistance of the fluid path resistance variable unit 83 is increased.

Conversely, as shown in FIG. 9B, when the ink flows in the direction D as indicated by arrows D (when the ink flows from the recording head 10 to the ink cartridge 40), the flowing force of the liquid overcomes the buoyancy, which in turn moves the valve body 88 in the direction of the port 86*b*. As a result, the flow path formed by the gap between the tapered pipe 87 and the valve body 88 is made wide, and the fluid resistance of the fluid path resistance variable unit 83 is reduced.

Furthermore, as shown in, for example, FIGS. 10A and 10B, if the flow path resistance variable unit 83 is so configured that the valve body 88 is biased by a spring 89, the same function as that of the configuration shown in FIGS. 9A and 9B is made possible. That is, the flow path resistance variable unit 83 may be configured that the valve body is free from the buoyancy with the provision of the spring 89. Furthermore, the shape and the like of the tapered pipe 87 and the valve body 88 in the flow path resistance variable unit 83 are not limited to those as shown in FIGS. 9A, 9B, 10A, and 10B, but the flow path resistance variable unit 83 having various configurations may be used so long as the same characteristics described above can be achieved.

Figure 11:
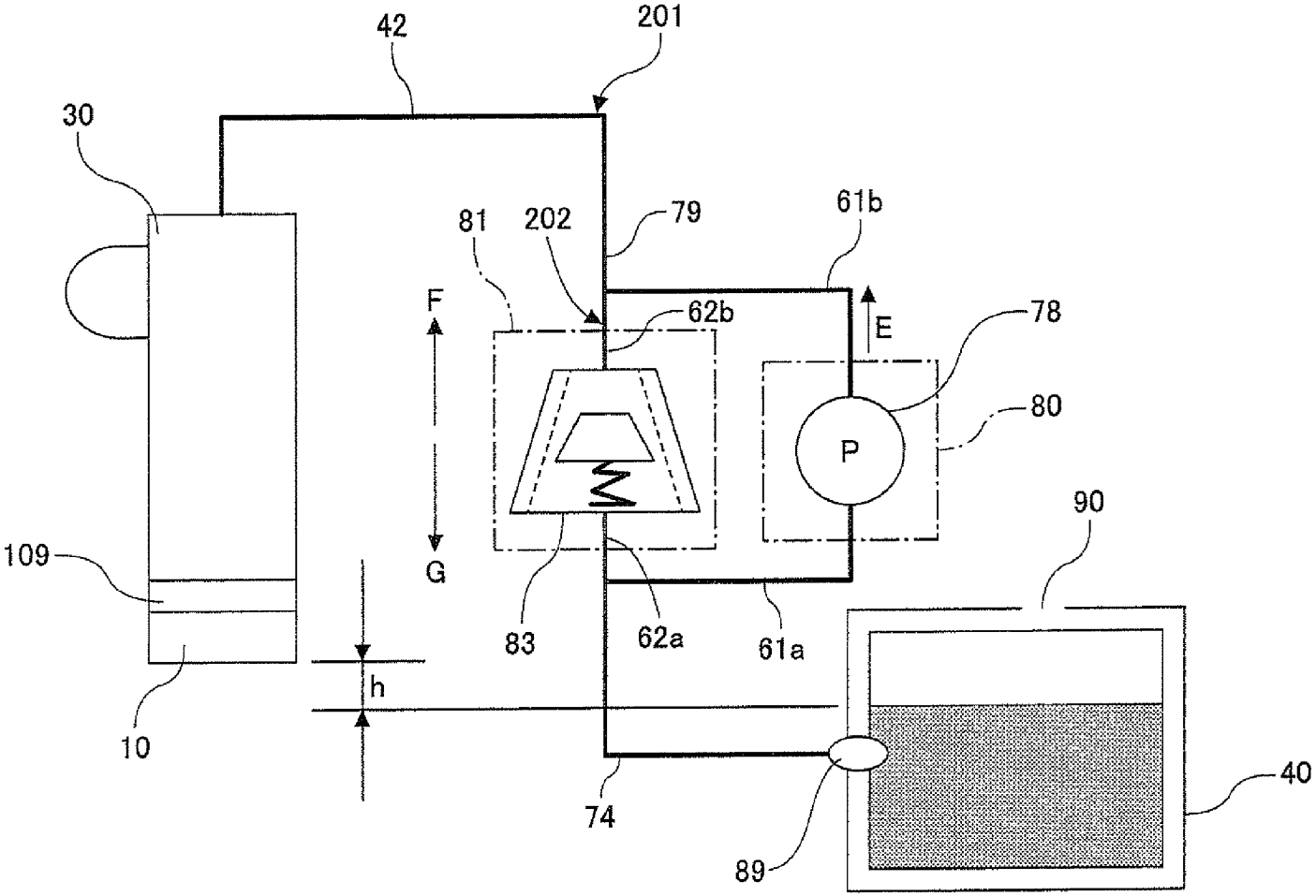
FIG. 11 is an explanatory diagram for explaining the entire configuration and the operations of the ink supplying system.

With reference also to FIG. 11, a description is now made of the entire configuration and the operations of the ink supplying system according to the first embodiment of the present invention.

The ink supplying system has the ink cartridge 40 serving as a liquid tank storing the liquid to be supplied to the recording head 10; a first flow path 201 communicated with the recording head 10 and the ink cartridge 40; the pump unit 80 (pump 78) serving as the liquid feeding unit provided in the first flow path 201; a second flow path 202 provided parallel to the pump unit 80 of the first flow path 201; and the pressure control unit 81 serving as the fluid resistance control unit provided in the second flow path 202.

The first flow path 201 is composed of paths on the side of the ports 73*b* and 73*a* (referred to as flow paths 61*a* and 61*b*) of the branch flow paths 74 and 79 and the ink supplying tube 42, which are arranged in this order from the side of the ink cartridge 40. Furthermore, the second flow path 202 is composed of paths on the side of the ports 72*b* and 72*a* (referred to as flow paths 62*a* and 62*b*) of the branch flow paths 74 and 79, which are arranged in this order from the side of the ink cartridge 40. Thus, the second flow path 202 provided with the pressure control unit 81 is communicated with the first flow path 201 on both the upstream and downstream sides of the pump 78 of the pump unit 80 of the first flow path 201 in the liquid feeding direction and communicated with the recording head 10 and the ink cartridge 40 via the first flow path 201.

The pump unit 80 has the successively-arranged four tubing pumps 78 shown in FIG. 7, and the pressure control unit 81 has the flow path resistance variable unit 83 having the configuration shown in FIGS. 10A and 10B. Note that the branch flow path 74 is connected to the ink cartridge 40 via a joint unit 89.

The ink cartridge 40 is provided with an air communication part 90 and arranged so that a liquid surface inside the ink cartridge 40 is positioned lower than the nozzle surface of the recording head 10. With this arrangement, when all the ink supplying paths are filled with the ink, the recording head 10 is maintained at a negative pressure due to a water head difference h between the recording head 10 and the liquid surface of the ink cartridge 40.

When the ink is ejected from the recording head 10, the flow path resistance variable unit 83 of the pressure control unit 81 is in the state shown in FIG. 10A. The ink is naturally supplied from the ink cartridge 40 to the recording head 10 via the opening part of the flow path resistance variable unit 83 and the ink supplying tube 42.

Here, if the viscosity of the ink to be ejected is large, if the fluid resistance of the ink supplying tube 42 is large, and if the flow rate of the ink to be ejected is large, supply of the ink may be delayed due to the fluid resistance of the ink supplying path.

Specifically, in the ink supplying system, ink supplying resistance is mainly caused by the ink supplying tube 42, the filter 109, and the joint unit 89. When the ink having high viscosity of 16 cP is ejected in a wide image forming apparatus (liquid ejection apparatus) having a long tube (i.e., the ink supplying tube 42 has a diameter of 3 mm and a length of 2500 mm), the fluid resistance of the ink supplying tube 42 is 2E10 ($Pa \cdot s/m^3$). Furthermore, in this embodiment, the fluid resistances of the filter 109 and the joint unit 89 are 1E10 ($Pa \cdot s/m^3$) and 6.6E9 ($Pa \cdot s/m^3$), respectively.

In this embodiment, the limit value of a pressure loss, at which the liquid ejection head constituting the recording head 10 can perform a stable ejection, is 2.5 kPa, and a flow rate when the ink is successively ejected from all the nozzles is 0.1 cc/s. Since the pressure loss at this time is 3.67 kPa even when the pressure control unit 81 does not exist, the ink cannot be naturally supplied with a simple water-head-difference ink supplying system.

As described above, when the pressure loss is increased due to the resistances of the ink supplying system to cause short refill of the ink, the pump 78 of the pump unit 80 is driven to feed the ink in the direction as indicated by an arrow E when the ink is supplied via the flow path resistance variable unit 83. With the feeding of the ink via the pump 78, a shortage amount of the ink to be supplied can be compensated (referred to as "refill assist").

Figure 12:
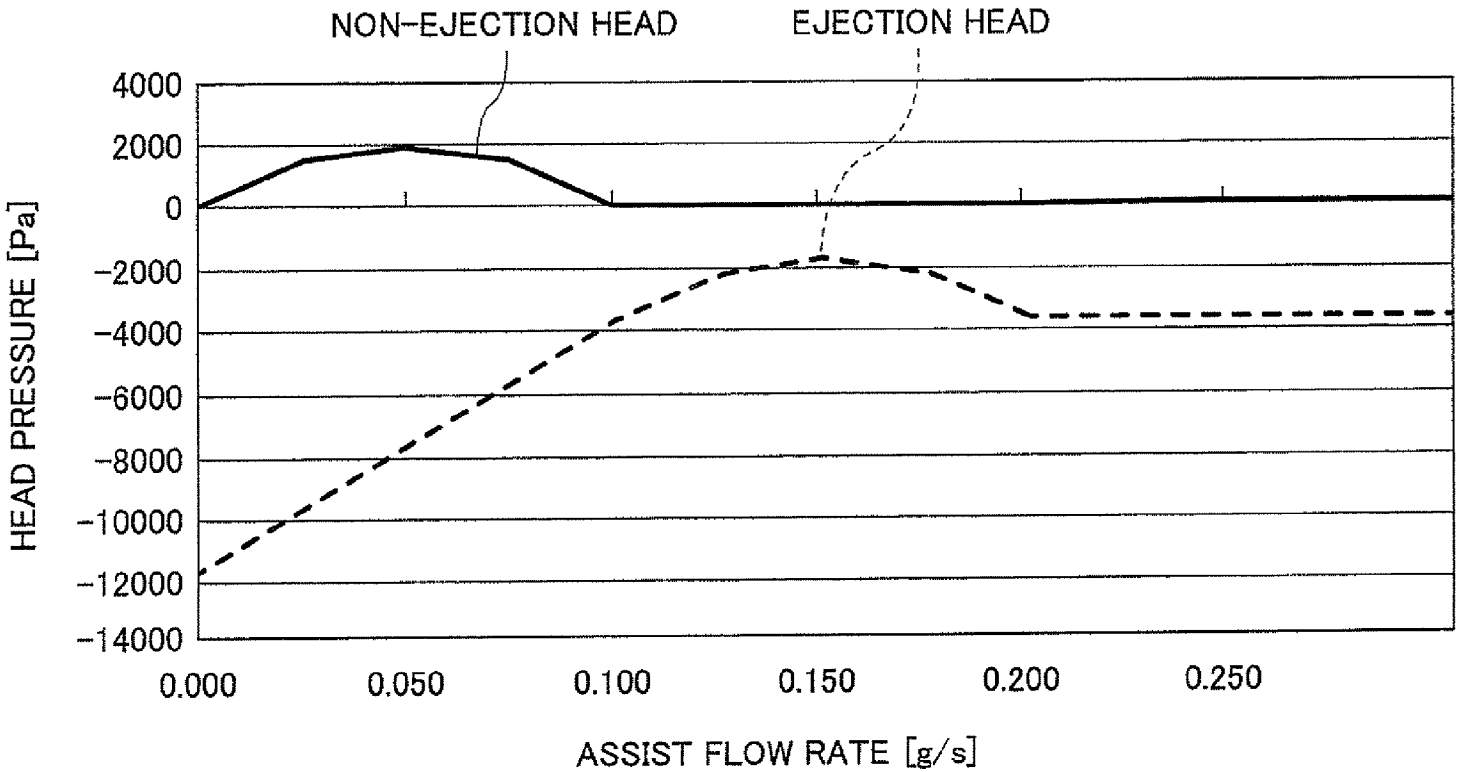
FIG. 12 is an explanatory diagram for showing an example of a relationship between a liquid feeding amount (assist flow rate) by a pump and a pressure of the recording head.

FIG. 12 is an explanatory diagram for showing an example of a relationship between a liquid feeding amount (assist flow rate) by the pump 78 and a pressure of the recording head 10. In this example, the flow path resistance variable unit 83 has the following characteristics. That is, when the ink flows in the direction as indicated by arrows C (when the ink flows from the ink cartridge 40 to the recording head 10) as shown in FIG. 10A, the flow path is made narrow. In this case, the fluid resistance is 8.1E10 (Pa·s/m$^3$). On the other hand, when the ink flows in the direction as indicated by arrows D as shown in FIG. 10B (when the ink flows from the recording head 10 to the ink cartridge 40), the flow path is made wide. In this case, the flow rate is greater than or equal to 0.1 cc/s, and the fluid resistance is kept minimum as 1.7E8 (Pa·s/m$^3$). When the ink flows in the direction as shown in FIG. 10B and the flow rate is less than 0.1 cc/s, the fluid resistance of the flow path resistance variable unit 83 lies in values between 1.7E8 and 8.1E10 (Pa·s/m$^3$).

When the ink having a viscosity of 16 cp is ejected so as to correspond to the flow rate of 0.1 cc/s from the recording head 10 in a state in which the pump 78 is stopped (assist flow rate is zero) as shown in FIG. 12, a pressure loss of 12 kPa occurs. Therefore, the ink cannot be ejected in this case. The pressure loss can be reduced in such a manner that the pump 78 is driven to supply the assist flow rate (the ink is fed from the ink cartridge 40 to the recording head 10 via the first flow path 201). For example, if the assist flow rate is set as 0.15 cc/s, the pressure of the recording head 10 can be set to about −2 kPa. Therefore, the ink can be stably ejected.

Since the four colors of the ink are ejected in the apparatus of this embodiment as described above, the four ink supplying systems having the configuration shown in FIG. 11 are provided so as to correspond to the respective colors. Four actuators such as motors for driving the pumps 78 may be provided corresponding to the respective colors of the pumps 78 so that the motors are separately controlled in accordance with the amount of the ink to be ejected from the respective recording heads 10. Alternatively, as shown in FIG. 7, if only one motor (actuator) 82 common to the pumps 78 (78K, 78C, 78M, and 78Y) for the respective colors is used, it is possible to simplify control of the apparatus, reduce the size of the apparatus, and reduce manufacturing costs of the apparatus.

Furthermore, when plural colors of the ink are ejected to form an image, the amounts of the ink to be ejected from the respective recording heads 10 are different. Therefore, there sometimes occurs a case in which the ink is ejected from all the nozzles of one recording head 10 or one nozzle array, but it is not ejected from other recording heads 10 or other nozzle arrays. Even in this situation, in the ink supplying system described above, since the fluid resistance is automatically based on the direction and the flow rate of the ink flowing in the flow path resistance variable unit 83, the pumps 78 are not required to be controlled in accordance with the flow rates of the ink to be ejected from the respective recording heads 10 and the respective nozzle arrays.

The principle of the refill assist in the ink supplying system described above is based on forcible ink supply to the recording head 10 with the pump 78. That is, refill of the ink is assisted by pressurized ink supply with the pump 78.

In other words, when the assist flow rate with the pump 78 is smaller than the flow rate of the ink to be ejected from the recording head 10, the liquid in the flow path resistance variable unit 83 flows in the direction as indicated by an arrow F shown in FIG. 11, which in turn cancels the pressure loss of the ink corresponding to the assist flow rate in the flow path resistance variable unit 83. On the other hand, when the assist flow rate with the pump 78 is greater than the flow rate of the ink to be ejected from the recording head 10, the liquid in the flow path resistance variable unit 83 flows in the direction as indicated by an arrow G shown in FIG. 11. In this case, the liquid corresponding to a difference between the assist flow rate and the flow rate of the ink to be ejected from the recording head 10 is caused to circulate the loop of the pressure control unit 81 and the pump unit 80. When the liquid flows in the direction as indicated by an arrow G in the flow path resistance variable unit 83, the pressure loss generated by the flow path resistance variable unit 83 is applied in a pressurized direction with respect to the recording head 10, which in turn cancels the pressure loss of the recording head 10.

When the pump 78 is uniformly assisted by one motor with respect to the plural recording heads 10, the flow rate of the ink in the direction as indicated by the arrow G is increased and the fluid resistance is reduced in the flow path resistance variable unit 83 as the amount of the ink ejected from the respective recording heads 10 is small. Therefore, an assist pressure with respect to the recording heads 10 is automatically reduced. In other words, a small assist is applied to the recording head 10 that does not require the assist because the flow rate of the ink to be ejected is small. On the other hand, a large assist is applied to the recording head 10 that requires the assist because the flow rate of the ink to be ejected is large.

From the reasons above, as shown in FIG. 12, a pressure is increased by about 8 kPa in an ejection head when no assist is applied where the assist flow rate is 0.01 cc/s, while almost no pressure is increased in a non-ejection head.

As described above, in the system having the plural ink supplying systems for supplying the plural ink, the pumps of all the ink supplying systems can be collectively driven by one actuator. Therefore, it is possible to simplify the configuration and control of the apparatus, reduce manufacturing costs of the apparatus, and reduce the size of the apparatus.

Furthermore, the viscosity of liquid is generally changed in accordance with a temperature of the liquid. Therefore, as shown in FIG. 2, the assist of the ink to the recording head 10 may be performed in such a manner that driving of the pump 78 is controlled based on a temperature around the apparatus, a temperature inside the apparatus, a temperature of the ink, each of which is measured by a temperature sensor 27, and predicted values thereof. In this manner, it is possible to realize a convenient apparatus corresponding to all temperatures.

Furthermore, if a pressure sensor is provided in the ink supplying path and a pressure change is measured when the ink corresponding to a predetermined flow rate is ejected from the recording head, the viscosity of the liquid directly related to a pressure loss can be detected correspondingly. Based on a detected result, parameters for controlling the pump 78 can be changed, and various liquids having each having different viscosity can be used. Furthermore, if the user is allowed to input the parameters while confirming ejection statuses, a mechanism for detecting the viscosity of the liquid is not required. As a result, the apparatus can be simplified.

Figure 13:
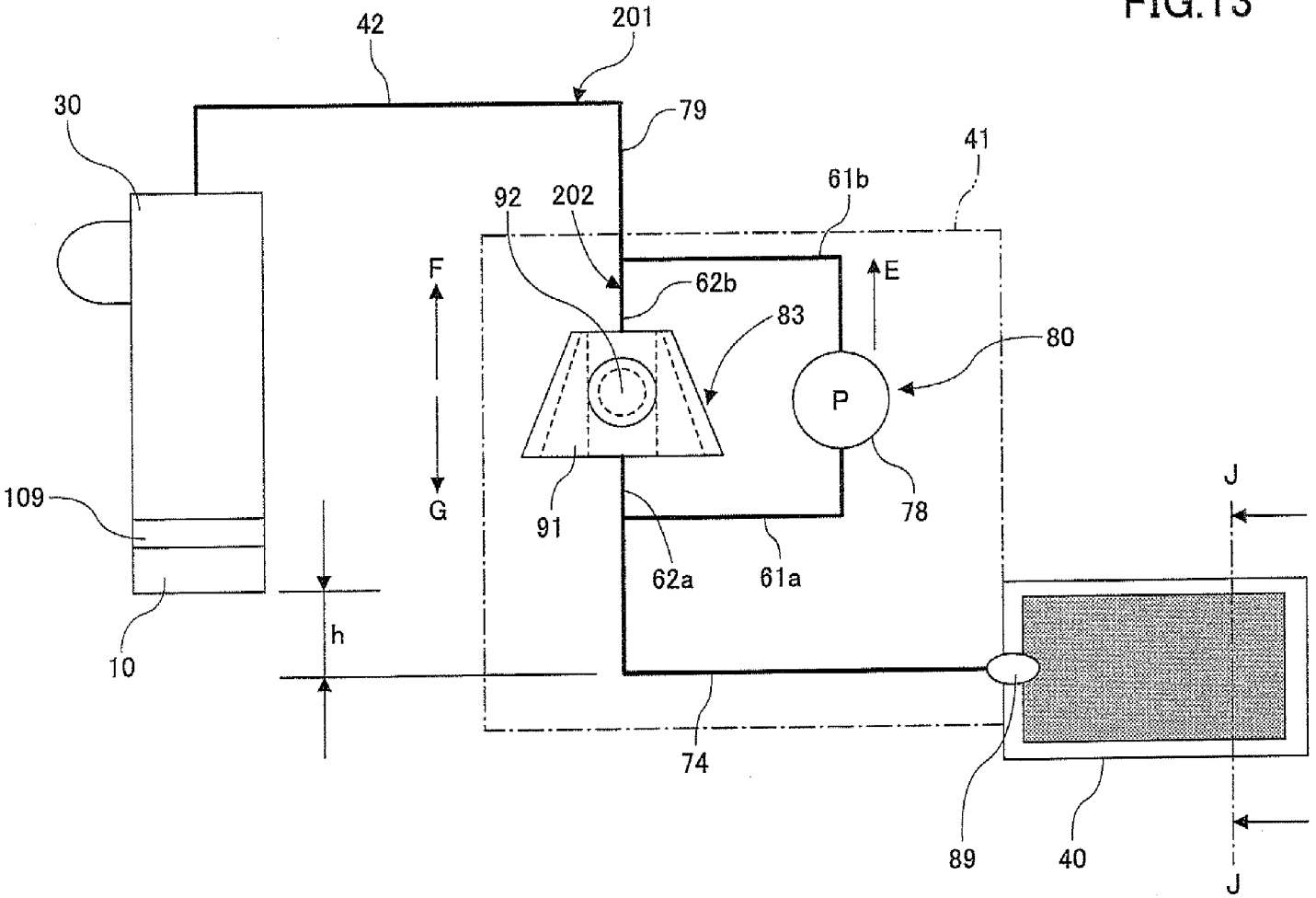
FIG. 13 is an explanatory diagram for explaining an outline of the ink supplying system according to a second embodiment of the present invention.

Next, with reference to FIGS. 13 through 15A and 15C, a description is made of the ink supplying system according to a second embodiment of the present invention. Note that FIG. 13 is a schematic explanatory view of the ink supplying system, FIGS. 14A and 14B are cross-sectional explanatory views taken along the line J-J in FIG. 13, and FIGS. 15A through 15C are explanatory views for explaining the fluid resistance variable unit.

Figure 14A:
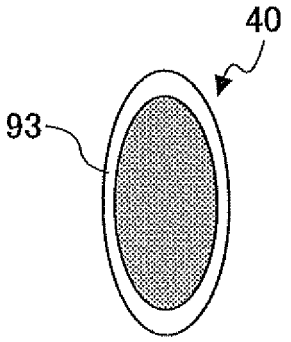
FIGS. 14A and 14B are cross-sectional explanatory views taken along the line J-J of the ink supplying system in FIG. 13.
Figure 14B:
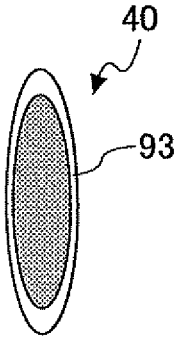

Here, the ink cartridge 40 has a bag member 93 formed of a flexible material that can freely transform (from a state shown in FIG. 14A to that shown in FIG. 14B) when the ink is consumed as shown in FIGS. 14A and 14B, and the ink is stored in the bag member 93. The ink cartridge 40 is arranged at a position below the nozzle surface of the recording head 10.

Since the ink supplying system is in a sealed state with this cartridge configuration, the quality of the ink to be supplied can be easily kept stable. In addition, since the recording head 10 is maintained at a negative pressure by a vertical interval between the recording head 10 and the ink cartridge 40, the negative pressure is stabilized.

Figure 15A:
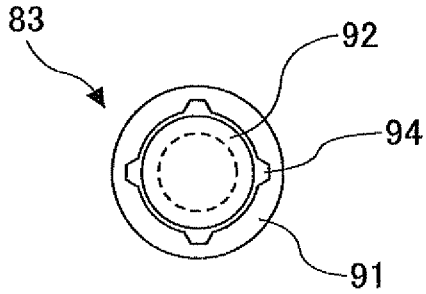
FIGS. 15A through 15C are explanatory views for explaining the fluid resistance variable unit of the ink supplying system.
Figure 15B:
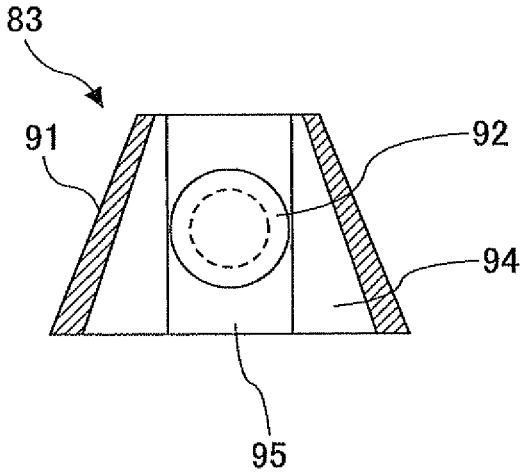
Figure 15C:
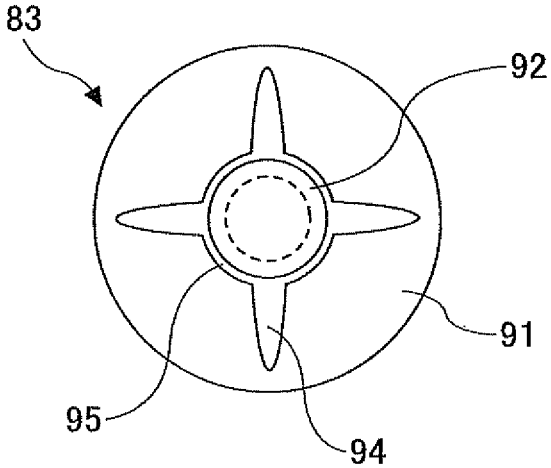

As shown in FIGS. 15A through 15C, the flow path resistance variable unit 83 has a hollow valve body 92 accommodated in a tapered pipe 91 and is configured to vertically move along a circular hole 95 formed at the central part of the tapered pipe 91. A groove 94 is formed at the external wall surface of the circular hole 95. The groove 94 is successively formed such that its cross-sectional area on the side to which the ink cartridge 40 is connected is made large and that on the side to which the recording head 10 is connected is made small.

Even if the flow path resistance variable unit 83 thus configured is used, the position of the valve body 92 is determined according to a balance between the buoyancy acting on the valve body 92, the assist flow rate by the pump 78, and the flow rate of the ink to be ejected from the recording head 10, and the assist pressure corresponding to the fluid resistance in the flow path resistance variable unit 83 at the corresponding position can be supplied to the recording head 10. As a result, the same refill assist effect as that described with reference to FIG. 11 can be obtained.

In this embodiment, as shown in FIG. 13, since the cartridge holder 41 is integrated with the pump 78 and the flow path resistance variable unit 83, the apparatus can be compacted and the number of sealing members related to connection can be reduced. As a result, the apparatus can be realized at low cost.

Figure 16:
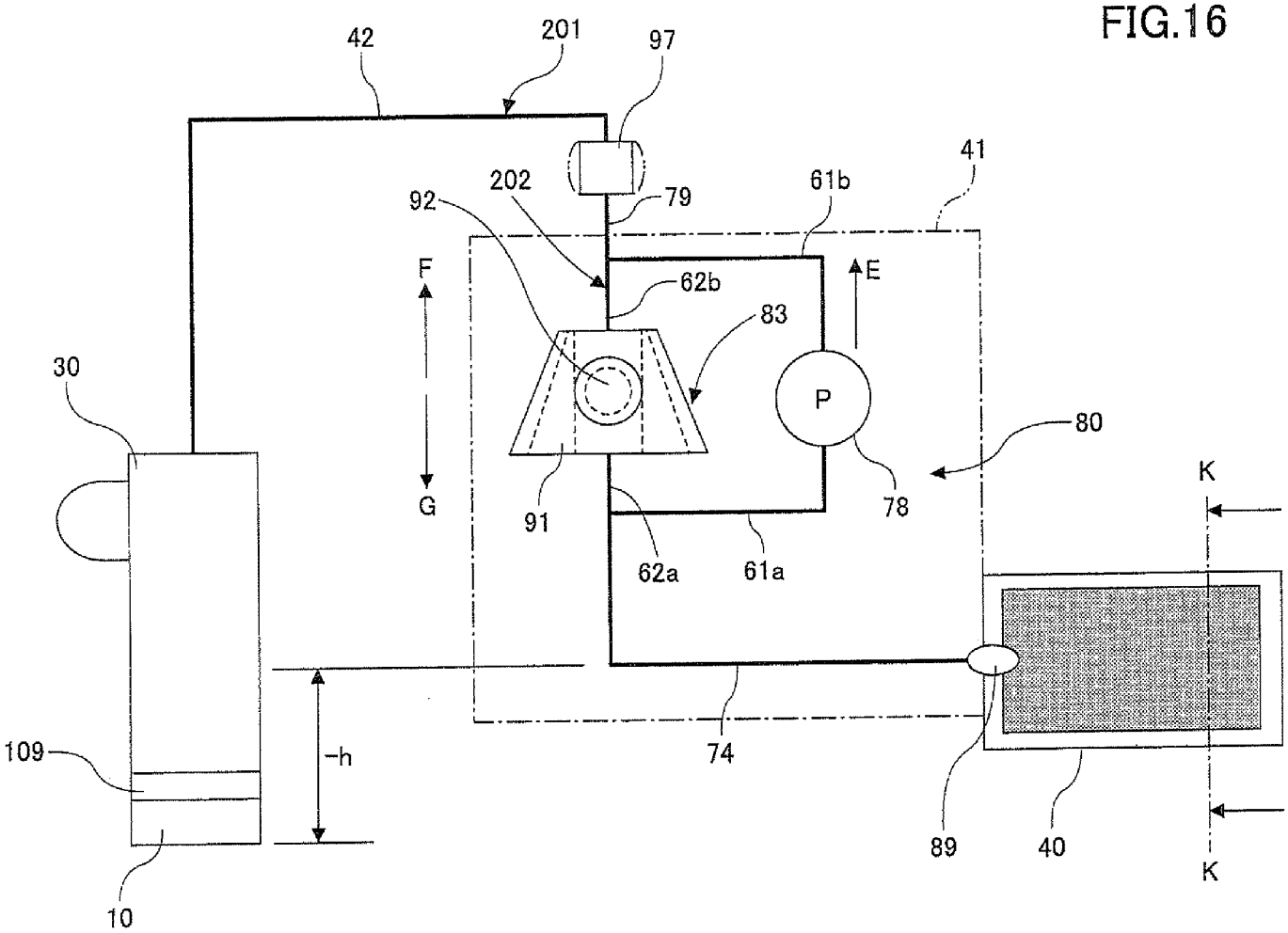
FIG. 16 is an explanatory diagram for explaining the ink supplying system according to a third embodiment of the present invention.
Figure 17A:
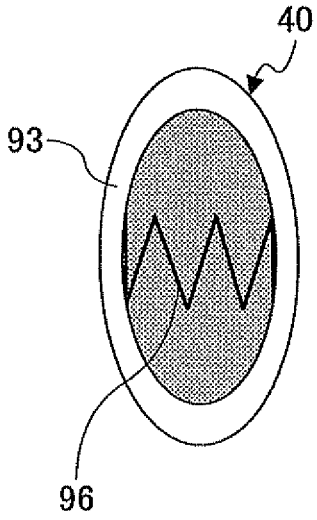
FIGS. 17A and 17B are cross-sectional explanatory views taken along the line K-K of the ink supplying system in FIG. 16.
Figure 17B:
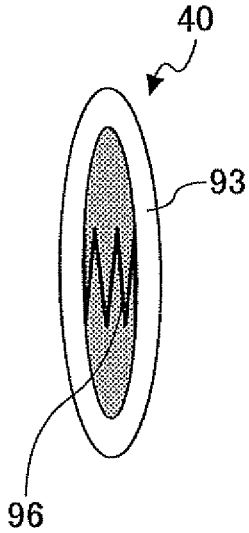

Next, with reference to FIGS. 16, 17A, and 17B, a description is made of the ink supplying system according to a third embodiment of the present invention. Note that FIG. 16 is an explanatory diagram of the ink supplying system, and FIGS. 17A and 17B are cross-sectional explanatory views taken along the line K-K in FIG. 16.

Here, the ink cartridge 40 has the bag member 93 formed of a flexible material that can freely transform (from a state shown in FIG. 17A to that shown in FIG. 17B) when the ink is consumed as shown in FIGS. 17A and 17B, and the ink is stored in the bag member 93. In the bag member 93, a compression spring 96 is provided.

With this configuration, the ink cartridge 40 voluntarily generates a negative pressure. Therefore, as shown in FIG. 16, the ink cartridge 40 can be arranged at a position (having a vertical interval of −h) higher than the nozzle surface of the recording head 10.

In this embodiment, a buffer member 97 serving as a pressure change absorption unit is provided between the ink supplying tube 42 and the pump 78. The buffer member 97 is constituted as a container that is formed of a flexible material such as a film and a rubber and has at least one wall surface, or it is constituted as a container in which a constant gas layer is formed. The buffer member 97 can attenuate an unnecessary pressure pulse generated by the pump 78 and absorb a transitional pressure change when the pump 78 is started and stopped. As a result, the pressure of the recording head 10 can be more stabilized.

Figure 18:
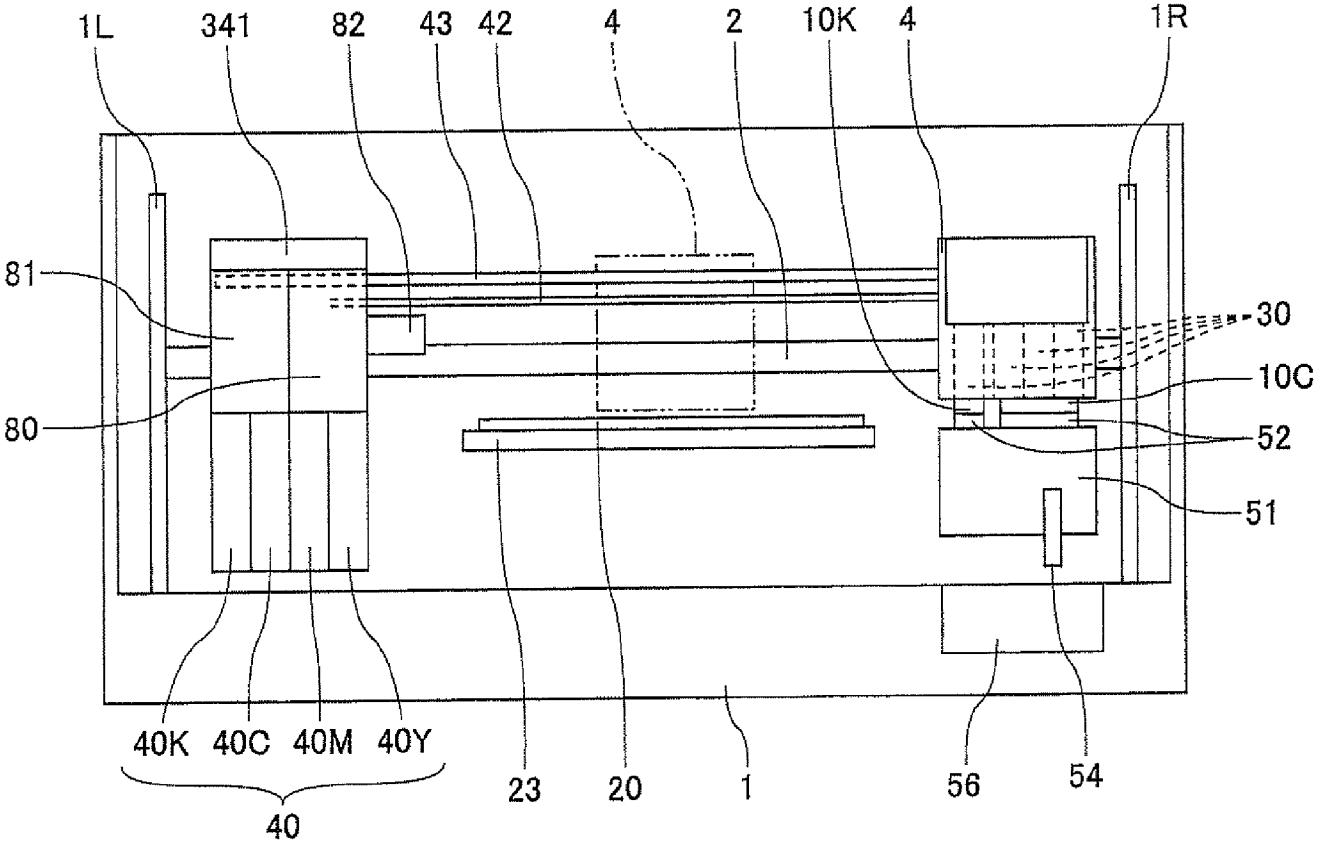
FIG. 18 is a schematic front explanatory view showing another example of the ink jet recording apparatus serving as an image forming apparatus according to the embodiments of the present invention.
Figure 19:
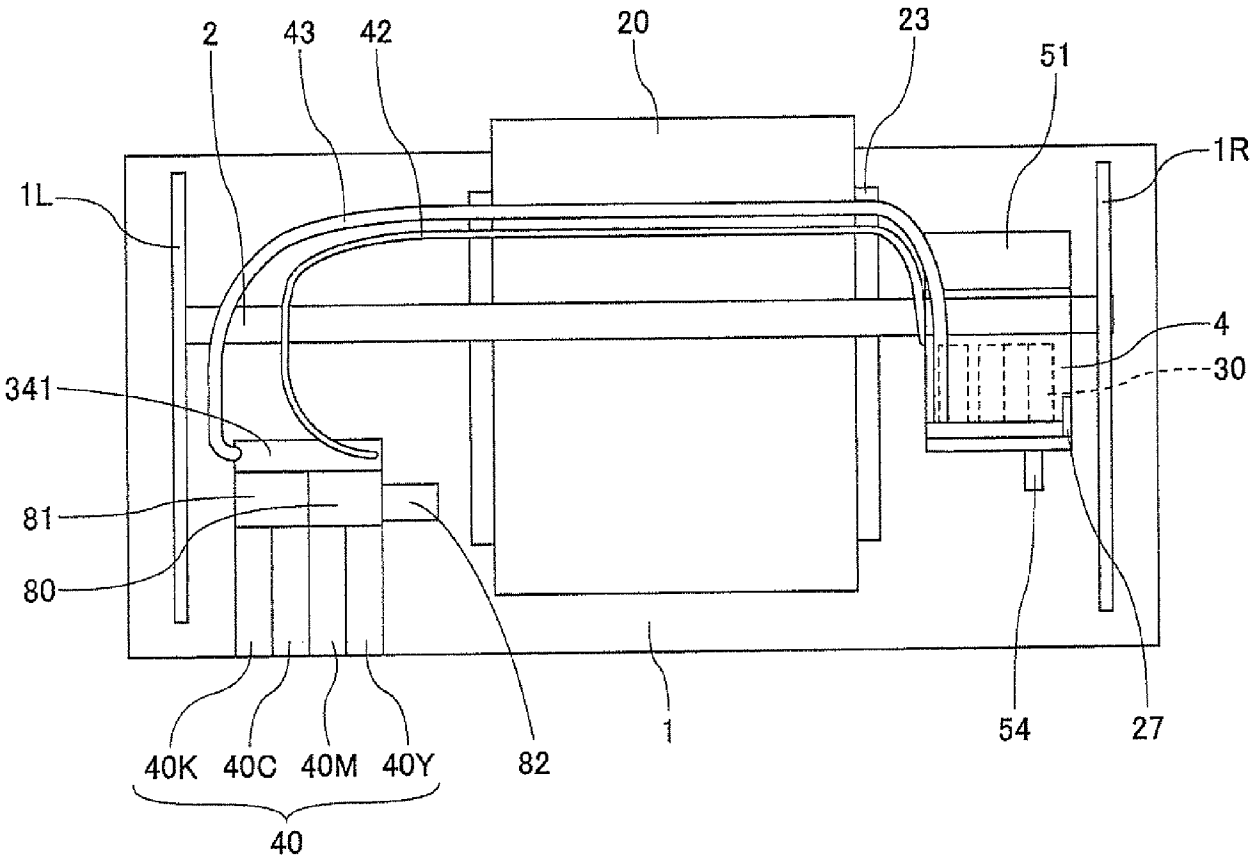
FIG. 19 is a schematic plan explanatory view of the ink jet recording apparatus.
Figure 20:
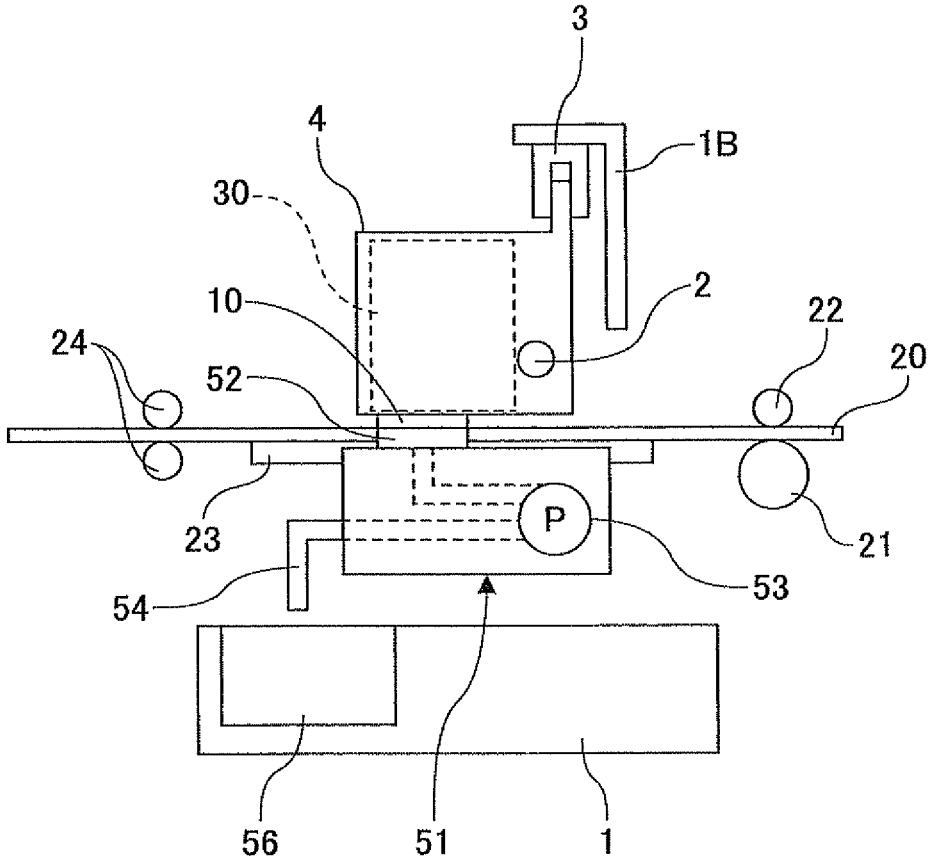
FIG. 20 is a schematic side explanatory view of the ink jet recording apparatus.

With reference to FIGS. 18 through 20, a description is now made of another example of the ink jet recording apparatus as the image forming apparatus to which the embodiments of the present invention are applied. Note that FIG. 18 is a schematic front explanatory view of the ink jet recording apparatus, FIG. 19 is a schematic plan explanatory view of the ink jet recording apparatus, and FIG. 20 is a schematic side explanatory view of the ink jet recording apparatus.

Here, besides the ink supplying tube 42 constituting a part of the first flow path connecting the ink cartridge 40 to the recording head 10, an ink supplying tube 43 constituting a second flow path is provided in the image forming apparatus described with reference to FIGS. 1 through 3. The respective colors of the ink are supplied from the ink cartridge (main tank) 40 serving as the liquid tank storing the respective colors of the ink to the sub-tank 30 via the first tube 42 and the second tube 43 serving as the ink supplying tubes.

Figure 21:
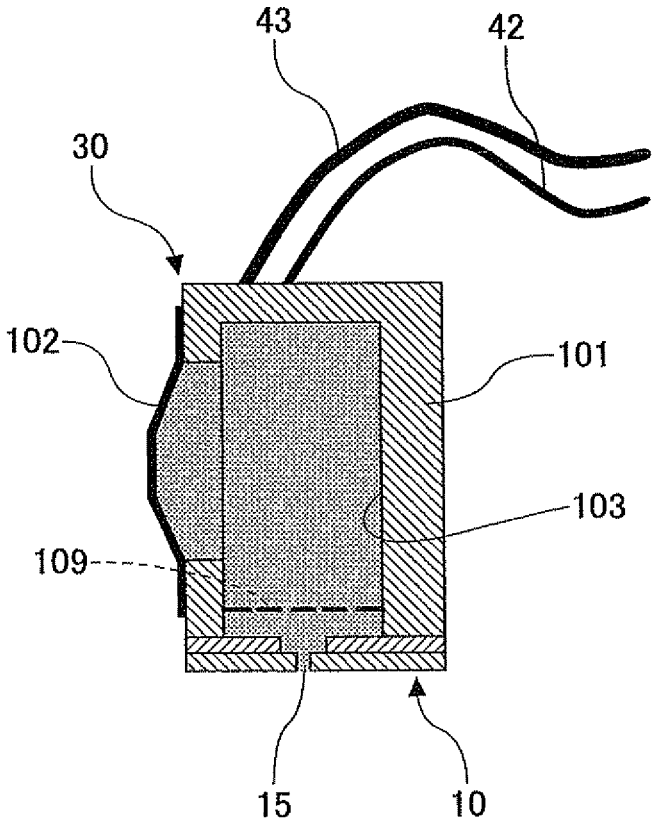
FIG. 21 is a cross-sectional explanatory view of the sub-tank of the ink supplying system according to a fourth embodiment of the present invention.
Figure 22:
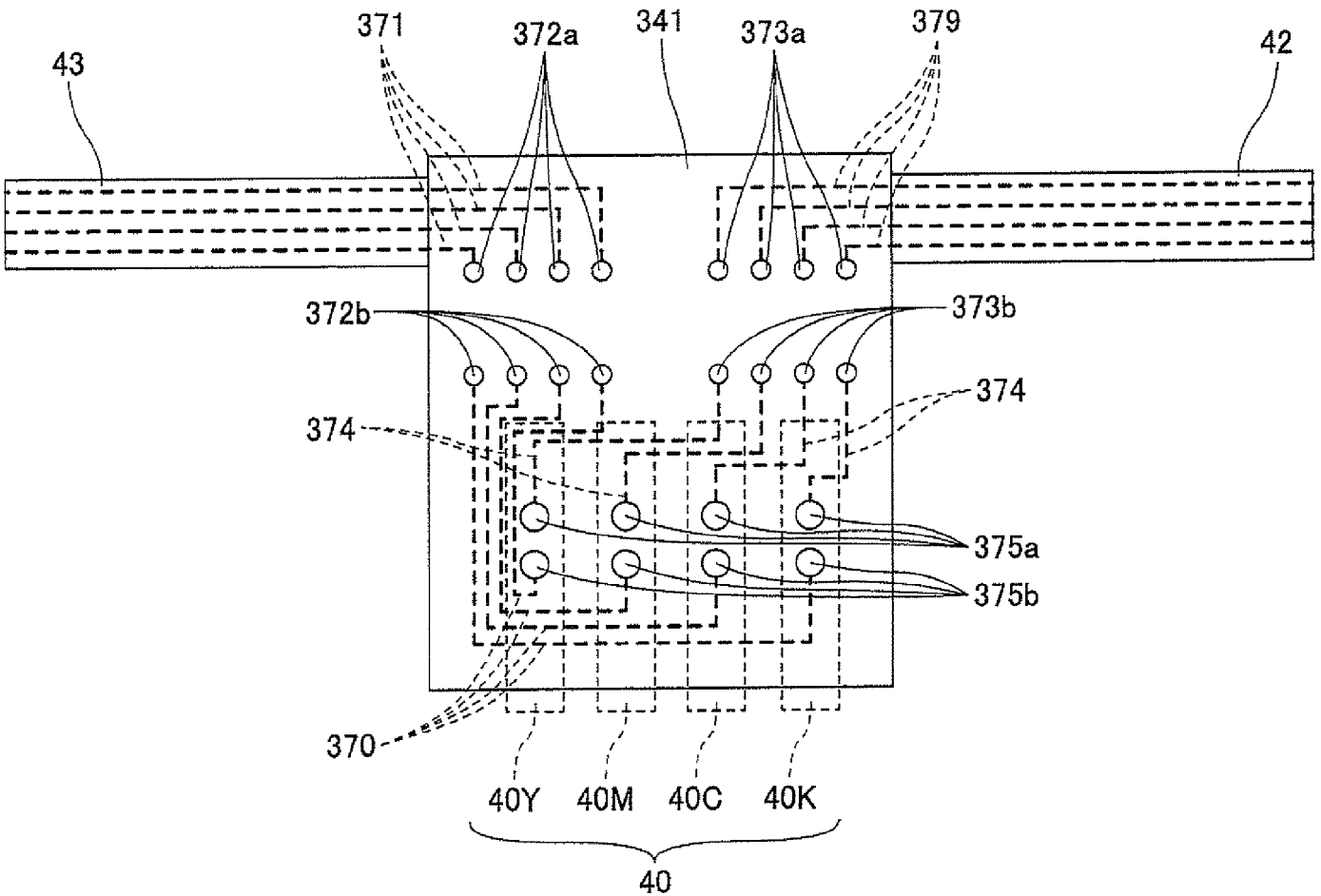
FIG. 22 is an explanatory view of the cartridge holder of the ink supplying system.

With reference also to FIGS. 21 and 22, a description is now made of the ink supplying system according to a fourth embodiment of the present invention applied to the ink jet recording apparatus. Note that FIG. 21 is a schematic cross-sectional explanatory view of the sub-tank of the ink supplying system, and FIG. 22 is an explanatory view of a cartridge holder of the ink supplying system.

As shown in FIG. 21, one ends of the ink supplying tubes 42 and 43 are connected to the sub-tank 30. As shown in FIGS. 18 and 19, the other ends of the ink supplying tubes 42 and 43 are connected to a cartridge holder 341 installed in the main body of the image forming apparatus. Note that other configurations of the sub-tank 30 are the same as those described above.

Similar to the cartridge holder 41 described above, the cartridge holder 341 is connected to the ink cartridge 40, the pump unit serving as the liquid feeding unit, and the pressure control unit 81 serving as the fluid resistance control unit.

As shown in FIG. 22, inner flow paths 370, 371, 374, and 379 are formed so as to correspond to the respective colors of the ink inside the cartridge holder 341. The inner flow paths 379 have pump connection ports 373*a* communicated with the pump unit 80. With the pump connection ports 373*a*, the first tube 42 is communicated with the pump unit 80. Furthermore, the inner flow paths 371 have pressure control ports 372*a* communicated with the pressure control unit 81. With the pressure control ports 372*a*, the second tube 43 is communicated with the pressure control unit 81. The inner flow paths 374 have the pump connection ports 373*b* and cartridge communication ports 375*a*. With the pump connection ports 373*b* and cartridge communication ports 375*a*, the ink cartridge 76 is communicated with the pump unit 80. The inner flow paths 370 have pressure control ports 372*b* communicated with the pressure control unit 81 and cartridge communication ports 385*b*. With the pressure control ports 372*b* and the cartridge communication ports 375*b*, the ink cartridge 40 is communicated with the pressure control unit 81.

Note that the configuration and the operations of the pump unit 80 and the pressure control unit 81 are the same as those described in the first embodiment.

Figure 23:
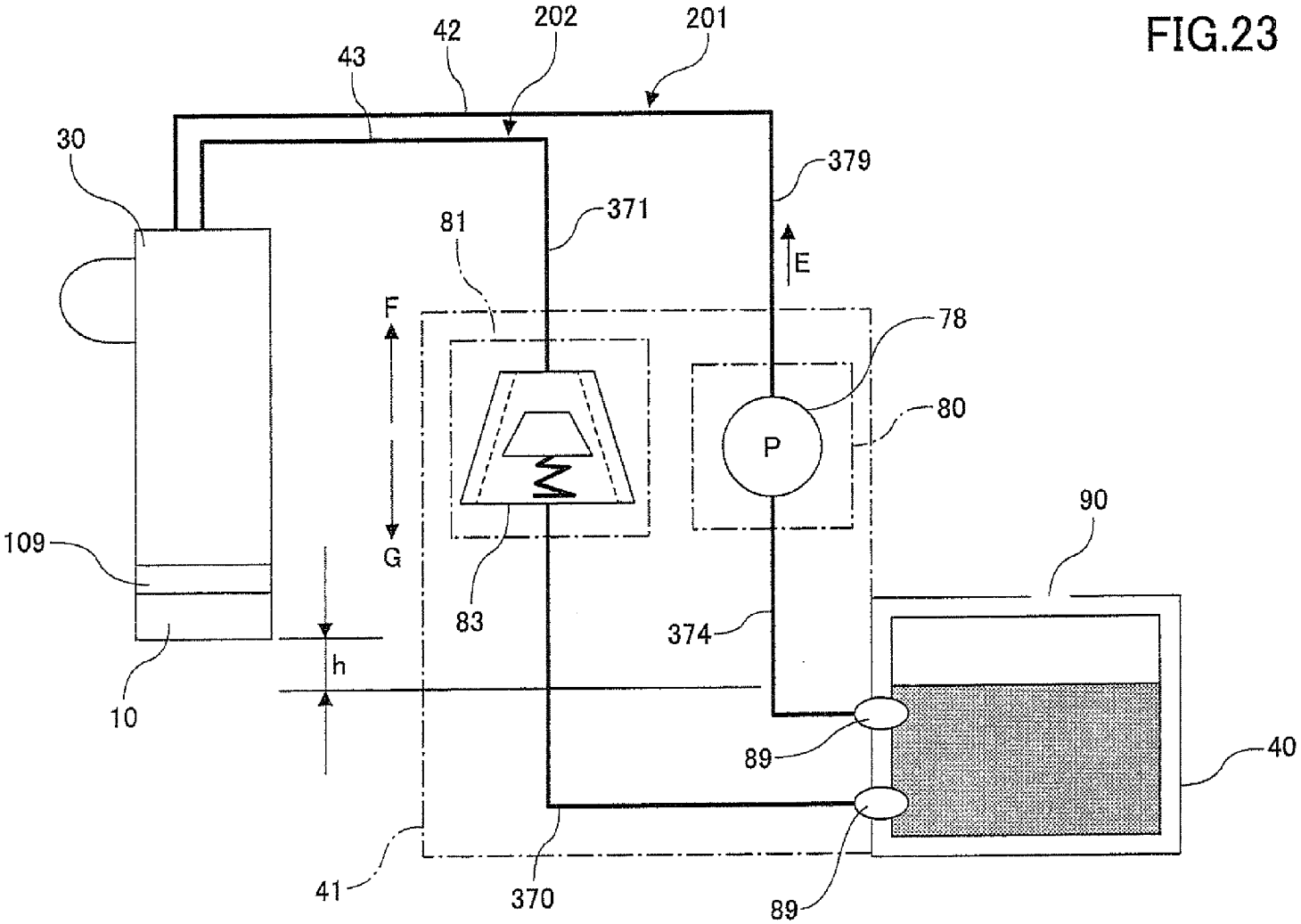
FIG. 23 is an explanatory diagram for explaining the entire configuration and the operations of the ink supplying system.

With reference to FIG. 23, a description is now made of the entire configuration and the operations of the ink supplying system according to a fourth embodiment of the present invention.

The ink supplying system has the ink cartridge 40 serving as the liquid tank storing the liquid to be supplied to the recording head 10; the first flow path 201 communicated with the recording head 10 and the ink cartridge 40; the pump unit 80 (pump 78) serving as the liquid feeding unit provided in the first flow path 201; the second flow path 202 provided parallel to the pump unit 80 of the first flow path 201; and the pressure control unit 81 serving as the fluid resistance control unit provided in the second flow path 202.

The first flow path 201 is composed of the inner flow paths 374 and 379 and the ink supplying tube 42, which are arranged in this order from the side of the ink cartridge 40. Furthermore, the second flow path 202 is composed of the inner flow paths 370 and 371 and the ink supplying tube 43, which are arranged in this order from the side of the ink cartridge 40. Thus, the first flow path 201 and the second flow path 202 allow the ink cartridge 40 and the recording head 10 to communicate with each other via separate flow paths.

The pump unit 80 has the successively-arranged four tubing pumps shown in FIG. 7, and the pressure control unit 81 has the flow path resistance variable unit 83 having the configuration shown in FIG. 8. The ink cartridge 40 is provided with the air communication part 90 and arranged so that a liquid surface inside the ink cartridge 40 is positioned lower than the nozzle surface of the recording head 10. With this arrangement, when all the ink supplying paths are filled with the ink, the recording head 10 is maintained at a negative pressure due to a water head difference h between the recording head 10 and the liquid surface of the ink cartridge 40.

When the ink is ejected from the recording head 10, the flow path resistance variable unit 83 of the pressure control unit 81 is in the state shown in FIG. 10A. The ink is naturally supplied from the ink cartridge 40 to the recording head 10 via the opening part of the flow path resistance variable unit 83 and the ink supplying tube 43 (second tube: second flow path 302). Here, if the viscosity of the ink to be ejected is large, if the fluid resistance of the second tube 43 is large, and if the flow rate of the ink to be ejected is large, the supply of the ink may be delayed due to the fluid resistance of the ink supplying path.

Specifically, in the ink supplying system, ink supplying resistance is mainly caused by the second tube 43, the filter 109, and the joint unit 89. When the ink having high viscosity of 16 cP is ejected in the wide image forming apparatus (liquid ejection apparatus) in which a long tube has a diameter of 3 mm and a length of 2500 mm, the fluid resistance of the second tube 43 is 2e10 ($Pa \cdot s/m^3$) (the fluid resistance of a double tube is 1e10 ($Pa \cdot s/m^3$)). Furthermore, in this embodiment, the fluid resistances of the filter 109 and the joint unit 89 are 1e10 ($Pa \cdot s/m^3$) and 6.6e9 ($Pa \cdot s/m^3$), respectively.

In this embodiment, the limit value of a pressure loss, at which the liquid ejection head constituting the recording head 10 can perform a stable ejection, is 2.5 kPa, and a flow rate when the ink is successively ejected from all the nozzles is 0.1 cc/s. Since the pressure loss at this time is 3.27 kPa even when the pressure control unit 81 does not exist, the ink cannot be naturally supplied with a simple water-head-difference ink supplying system.

As described above, when the pressure loss is increased due to the resistances of the ink supplying system to cause short refill of the ink, the pump 78 is driven to feed the ink in the direction as indicated by an arrow E. With the feeding of the ink via the pump 78, a shortage amount of the ink to be supplied can be compensated (referred to as "refill assist").

Figure 24:
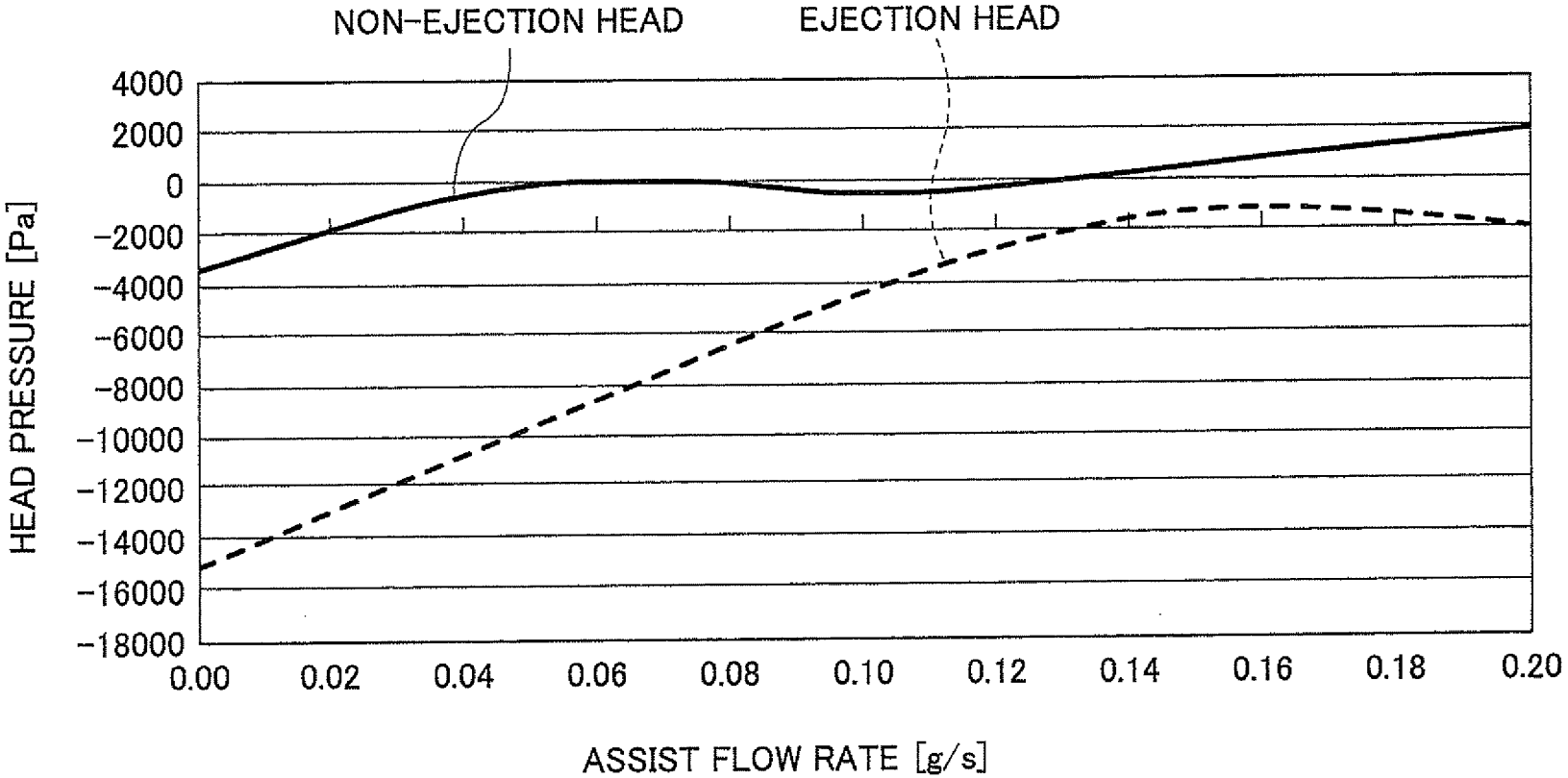
FIG. 24 is an explanatory diagram for showing an example of a relationship between the liquid feeding amount (assist flow rate) by the pump and a pressure of the recording head.

FIG. 24 is an explanatory diagram for showing an example of a relationship between a liquid feeding amount (assist flow rate) by the pump 78 and a pressure of the recording head 10. In this example, the flow path resistance variable unit 83 has the following characteristics. That is, when the ink flows in the direction as indicated by arrows C (when the ink flows from the ink cartridge 76 to the recording head 10) as shown in FIG. 10A, the flow path is made narrow. In this case, the fluid resistance is 8.1e10 ($Pa \cdot s/m^3$). On the other hand, when the ink flows in the direction as indicated by arrows D as shown in FIG. 10B (when the ink flows from the recording head 10 to the ink cartridge 76), the flow path is made wide. In this case, the flow rate is greater than or equal to 0.1 cc/s, and the fluid resistance is kept minimum as 1.7e8 ($Pa \cdot s/m^3$).

When the ink flows in the direction as shown in FIG. 10B and the flow rate is less than 0.1 cc/s, the fluid resistance of the flow path resistance variable unit 83 lies in values between 1.7e8 and 8.1e10 ($Pa \cdot s/m^3$). When the ink having a viscosity of 16 cp is ejected so as to correspond to the flow rate of 0.1 cc/s from the recording head 10 in a state in which the pump 78 is stopped (assist flow rate is zero) as shown in FIG. 24, a pressure loss of 15 kPa occurs. Therefore, the ink cannot be ejected in this case.

The pressure loss can be reduced in such a manner that the pump 78 is driven to supply the assist flow rate (the ink is fed from the ink cartridge 40 to the recording head 10 via the first flow path 301). For example, if the assist flow rate is set as 0.125 cc/s, the pressure of the recording head 10 can be set to about −2.4 kPa. Therefore, the ink can be stably ejected.

Figure 27:
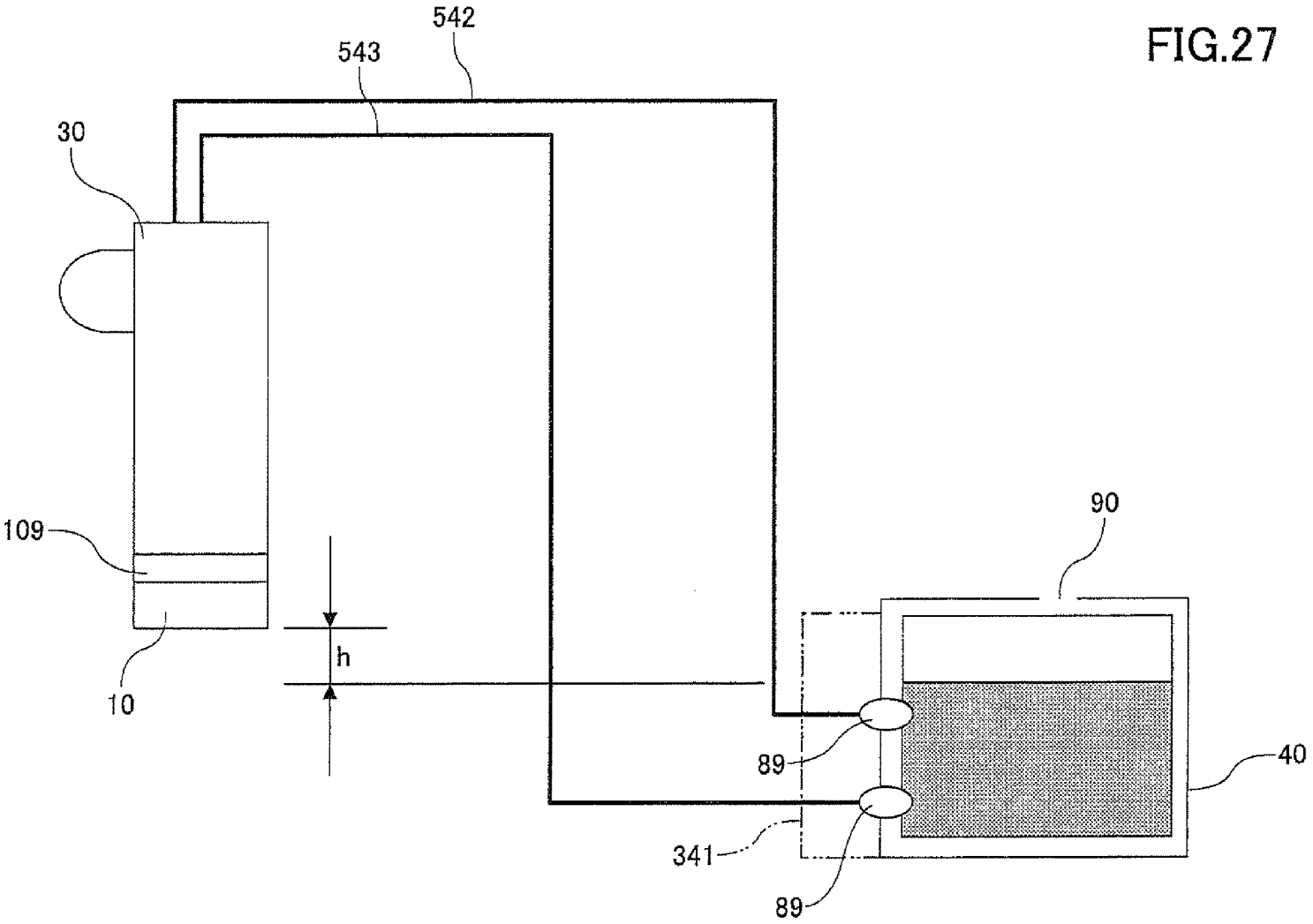
FIG. 27 is an explanatory diagram for explaining an outline of the ink supplying system according to a comparative example.

With reference to FIG. 27, a description is now made of, as a comparative example, a method for supplying the ink while maintaining a stabilized negative pressure with a water head difference. The comparative example shown in FIG. 27 refers to a system in which two ink supplying tubes 542 and 543 are used to naturally supply the ink. Similar to the image forming apparatus described above, the system of the comparative example uses a wide image forming apparatus in which a long tube has a diameter of 3 mm and a length of 2500 mm. When the ink having high viscosity of 16 cP is ejected in the wide image forming apparatus, a pressure loss is 2.72 kPa. In this case, so-called solid printing in which the ink is ejected from all the nozzles 15 cannot be normally performed.

In order to reduce the pressure loss, there is a method for increasing the number of tubes to be connected. However, this method is not preferable because manufacturing costs are increased, a system becomes complicated, and all the tubes cannot be satisfactorily filled with the ink. Another method for reducing the pressure loss is to thicken a tube. When the tube is thickened, bending performance of the tube becomes poor. Therefore, the image forming apparatus must be increased in size so as to allow the tube to move around. Moreover, since the scanning load of the carriage is increased, a carriage scanning motor must be increased in size. As a result, various problems including increased manufacturing costs and increased vibrations at main scanning occur. Furthermore, in the configuration shown in FIG. 28, the recording head 10 and the ink cartridge 40 are connected to each other only by the tubes. Therefore, if air foam intrudes in the tubes 542 and 543, it is removed only when the ink is ejected from the recording head 10. As a result, an ink amount to be uselessly ejected is increased.

Figure 28:
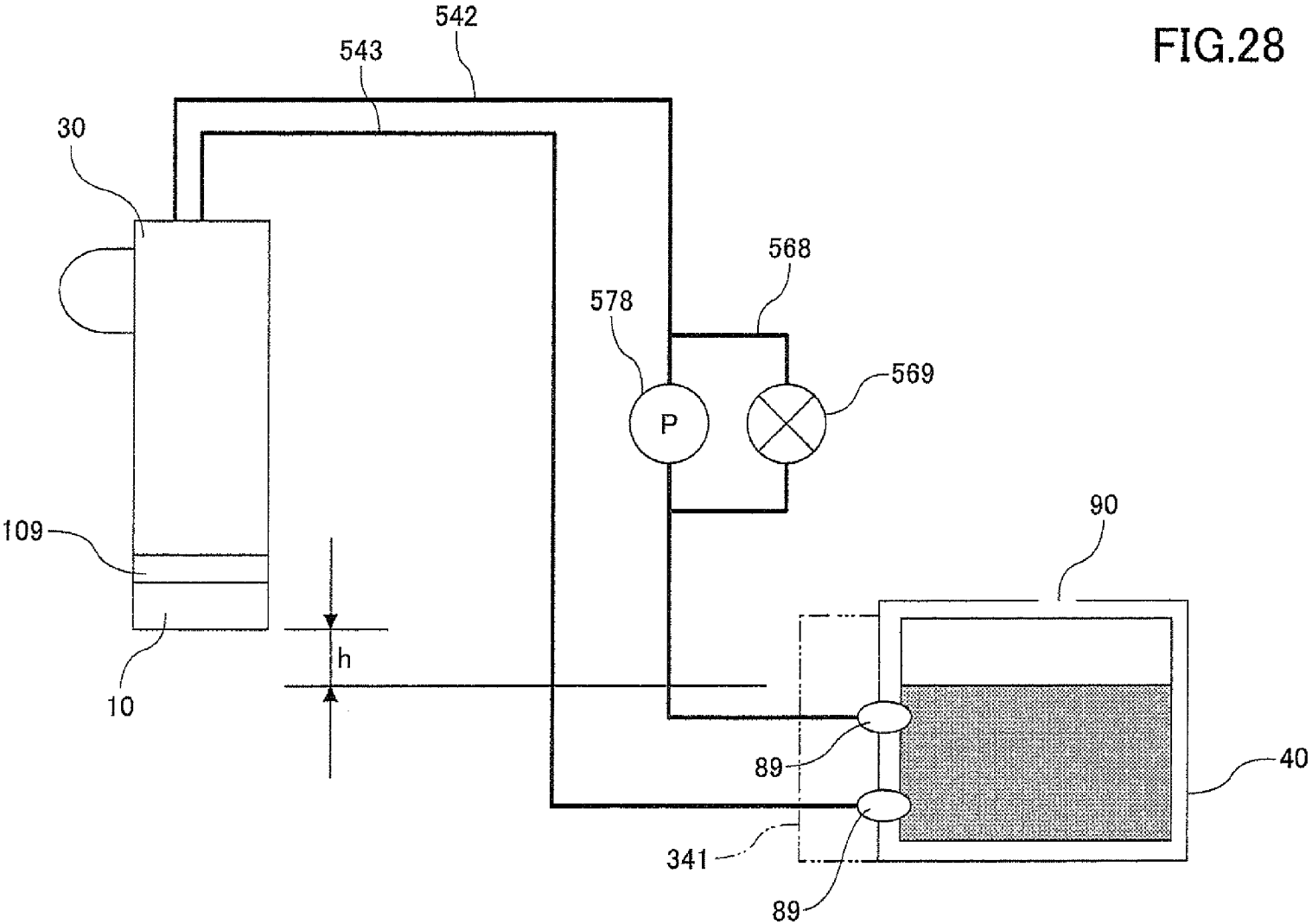
FIG. 28 is an explanatory diagram for explaining an example of a configuration for discharging air foam in the comparative example.

In order to increase air foam discharging performance in the system of this comparative example, a pump 578 is provided in any tube (the tube 542 in this example), and a flow path 568 that bypasses the pump 578 and an opening/closing valve 569 are further provided as shown in FIG. 28. However, even in this configuration shown FIG. 28, the pressure loss described above still remains. As a result, the problems including thickening of the tube and increased manufacturing costs due to the complicated system cannot be solved.

Conversely, in the configuration according to the fourth embodiment shown in FIG. 23, the thickening of the tubes 42 and 43 is not required, and the ink can be supplied based on the assist flow rate generated by the pump 78 without causing the pressure loss. Furthermore, even if air foam intrudes into the tubes 42 and 43, it can be discharged into the ink cartridge 40 by circulation with the pump 78. Therefore, the ink is not required to be uselessly ejected for discharging the air foam.

If a reversible pump (that can feed the liquid in any direction) is used as the pump 78 for the circulation of air foam, the air foam can be discharged into the ink cartridge 40 even if the liquid is fed in any of the direction in which the liquid is fed from the ink cartridge 40 to the recording head 10 and the direction in which the liquid is fed from the recording head 10 to the ink cartridge 40. However, the resistance of the valve of the flow path resistance variable unit 81 is reduced when the liquid flows in the direction as indicated by the arrow G in FIG. 23 described above. Therefore, efficiency for discharging the air foam becomes much improved when the liquid is fed by the pump 78 from the ink cartridge 40 to the recording head 10.

Furthermore, in the system according to the fourth embodiment, the first flow path 201 allows a constant flow rate of the liquid to be forcibly fed by the pump 78. Therefore, the first tube 42 constituting the first flow path 201 can be made significantly thinner than the second tube 43 constituting the second flow path 202. In other words, the fluid resistance of the first flow path 201 can be smaller than that of the second flow path 202. Thus, the image forming apparatus can be manufactured at low cost without causing the problems such as an increase in the size of the apparatus and an increase in the scanning load of the carriage due to the poor bending performance of the tube described above.

Since the four colors of the ink are ejected in the image forming apparatus according to the embodiments of the present invention as shown in FIGS. 18 through 20, the four ink supplying systems having the configuration shown in FIG. 23 are provided so as to correspond to the respective colors. Four actuators such as motors for driving the pumps 78 may be provided corresponding to the respective colors of the pumps 78 so that the motors are separately controlled in accordance with the amount of the ink to be ejected from the respective recording heads 10. Alternatively, as described above, only one motor (actuator) 82 common to the pumps 78 (78K, 78C, 78M, and 78Y) for the respective colors can be used. Furthermore, when plural colors of the ink are ejected to form an image, the amounts of the ink to be ejected from the respective recording heads 10 are different. Therefore, there sometimes occurs a case in which the ink is ejected from all the nozzles of one recording head 10, but it is not ejected from other recording heads 10. Even in this situation, in the ink supplying system according to the embodiments of the present invention, since the fluid resistance is automatically based on the direction and the flow rate of the ink flowing in the flow path resistance variable unit 83, the pumps 78 are not required to be controlled in accordance with the flow rates of the ink to be ejected from the respective recording heads 10.

Here, with reference to FIG. 23, a description is more specifically made of the principle of the refill assist according to the embodiments of the present invention.

The principle of the refill assist in the ink supplying system described above is based on forcible ink supply to the recording head 10 with the pump 78. That is, refill of the ink is assisted by pressurized ink supply with the pump 78. In other words, when the assist flow rate with the pump 78 is smaller than the flow rate of the ink to be ejected from the recording head 10, all the ink fed by pump 78 flows to the recording head 10 via the first flow path 201, and the ink corresponding to the shortfall is supplied to the recording head 10 via the second flow path 202. Accordingly, the liquid in the flow path resistance variable unit 83 flows in the direction as indicated by the arrow F in FIG. 23. However, since the amount of the ink flowing in the second tube 43 constituting the second flow path 202 as a main factor for causing a pressure loss is reduced by an amount corresponding to the assist flow rate, the pressure loss can be reduced.

On the other hand, when the assist flow rate with the pump 78 is greater than the flow rate of the ink to be ejected from the recording head 10, all the ink fed by the pump 78 flows to the recording head 10 via the first flow path 201, and a surplus of the ink reversely flows in the second flow path 202 and then flows in the flow path resistance variable unit 83 in the direction as indicated by the arrow G in FIG. 23. In this case, the liquid corresponding to a difference between the assist flow rate and the flow rate of the ink to be ejected from the recording head 10 is caused to circulate the loop of the pump unit 80, the first flow path 201, the second flow path 202, the pressure control unit 81, and the ink cartridge 40.

When the liquid flows in the direction as indicated by the arrow G in the second flow path 202 and the flow path resistance variable unit 83, the pressure loss generated by the second flow path 202 and the low path resistance variable unit 83 is applied in a pressurized direction with respect to the recording head 10, which in turn cancels the pressure loss of the recording head 10. When the amount of the ink to be ejected from the recording head 10 is small, the pressure loss is originally small. Therefore, the refill assist is not required. However, in this state, since the flow rate of the ink in the flow path resistance variable unit 83 is increased in the direction as indicated by the arrow G, the valve body 88 is lowered as shown in FIGS. 9B and 10B and the fluid resistance is reduced. Therefore, an assist pressure with respect to the recording heads 10 is automatically reduced. In other words, a small assist is applied to the recording head 10 that does not require the assist because the flow rate of the ink to be ejected is small. On the other hand, a large assist is applied to the recording head 10 that requires the assist because the flow rate of the ink to be ejected is large.

From the reasons above, as shown in FIG. 24, a pressure is increased by about 10 kPa in an ejection head when no assist is applied where the assist flow rate is 0.1 cc/s, while a pressure is increased by only about 3 kPa in a non-ejection head.

As described above, in the system having the plural ink supplying systems for supplying the plural ink, the pumps of all the ink supplying systems can be collectively driven by one actuator. Therefore, it is possible to simplify the configuration and control of the apparatus, reduce manufacturing costs of the apparatus, and reduce the size of the apparatus. Furthermore, the viscosity of liquid is generally changed in accordance with a temperature of the liquid. Therefore, as shown in FIG. 19, the assist of the ink to the recording head 10 may be performed in such a manner that driving of the pump 78 is controlled based on a temperature around the apparatus, a temperature inside the apparatus, a temperature of the ink, each of which is measured by the temperature sensor 27, and predicted values thereof. In this manner, it is possible to realize a convenient apparatus corresponding to all temperatures. Furthermore, if a pressure sensor is provided in the ink supplying path and a pressure change is measured when the ink corresponding to a predetermined flow rate is ejected from the recording head, the viscosity of the liquid directly related to a pressure loss can be detected correspondingly. Based on a detected result, parameters for controlling the pump 78 can be changed, and various liquids having each having different viscosity can be used. Furthermore, if the user is allowed to input the parameters while confirming ejection statuses, a mechanism for detecting the viscosity of the liquid is not required. As a result, the apparatus can be simplified.

Figure 25:
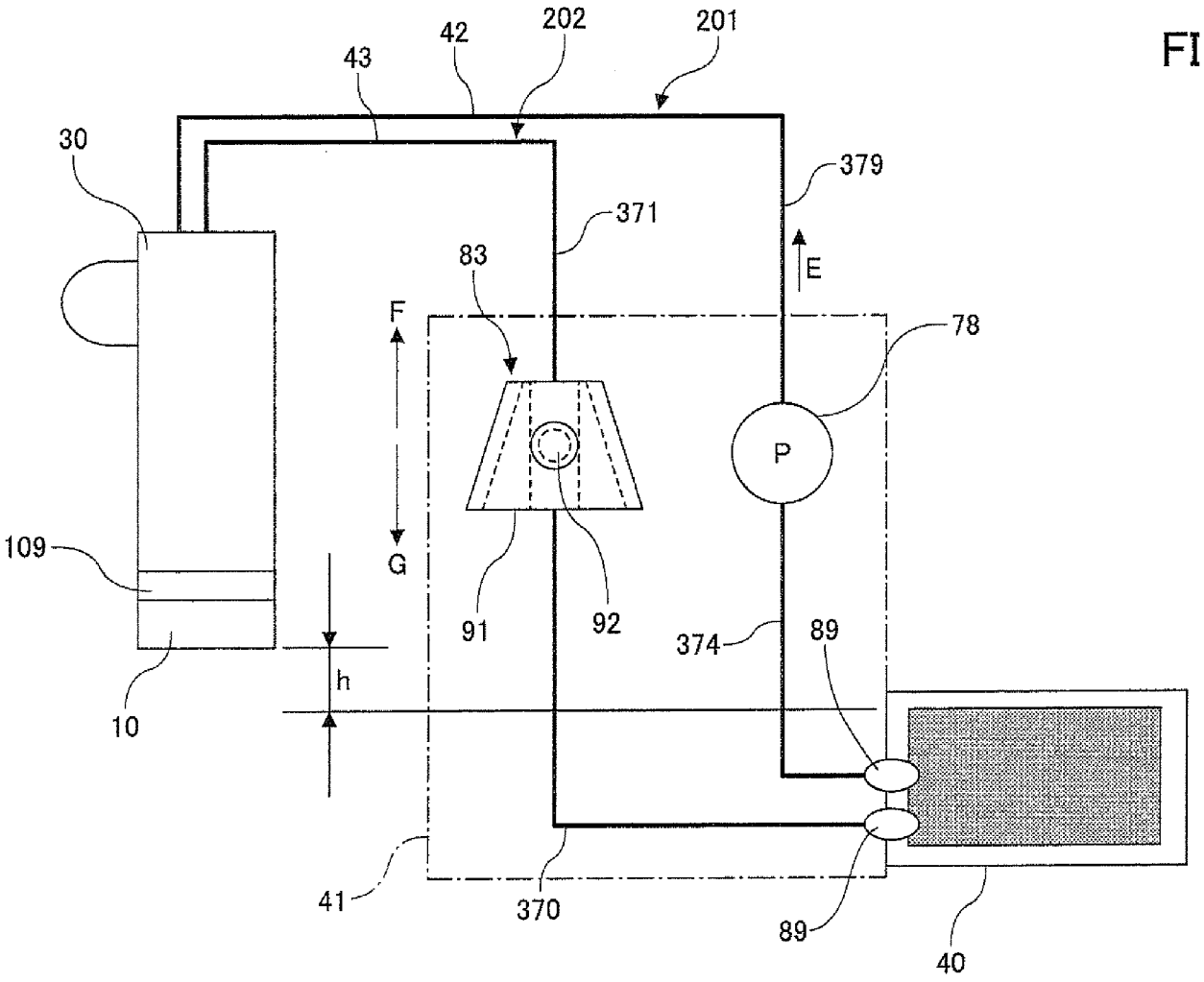
FIG. 25 is an explanatory diagram for explaining an outline of the ink supplying system according to a fifth embodiment of the present invention.

With reference to FIG. 25, a description is now made of the ink supplying system according to a fifth embodiment of the present invention.

This embodiment is a combination of the configurations of the second and the fourth embodiments. In other words, as shown in FIGS. 14A and 14B, the ink cartridge 40 has the bag member 93 formed of a flexible material that can freely transform when the ink is consumed, and the ink is stored in the bag member 93. The ink cartridge 40 is arranged at a position below the nozzle surface of the recording head 10. Since the ink supplying system is in a sealed state with this cartridge configuration, the quality of the ink to be supplied can be easily kept stable. In addition, since the recording head 10 is maintained at a negative pressure by a vertical interval between the recording head 10 and the ink cartridge 40, the negative pressure is stabilized.

As shown in FIGS. 15A through 15C, the flow path resistance variable unit 83 has the hollow valve body 92 accommodated in the tapered pipe 91 and is configured to vertically move along the circular hole 95 formed at the central part of the tapered pipe 91. The groove 94 is formed at the external wall surface of the circular hole 95. The groove 94 is successively formed such that its cross-sectional area on the side to which the ink cartridge 40 is connected is made large and that on the side to which the first tube 42 is connected is made small. Even if the flow path resistance variable unit 83 thus configured is used, the position of the valve body 92 is determined according to the balance between the buoyancy acting on the valve body 92, the assist flow rate by the pump 78, and the flow rate of the ink to be ejected from the recording head 10, and the assist pressure corresponding to the fluid resistance in the flow path resistance variable unit 83 at the corresponding position can be supplied to the recording head 10. As a result, the same refill assist effect as that described in the fourth embodiment can be obtained.

In this embodiment, since the cartridge holder 41 is integrated with the pump 78 and the flow path resistance variable unit 83, the apparatus can be compacted and the number of sealing members related to connection can be reduced. As a result, the apparatus can be realized at low cost.

Figure 26:
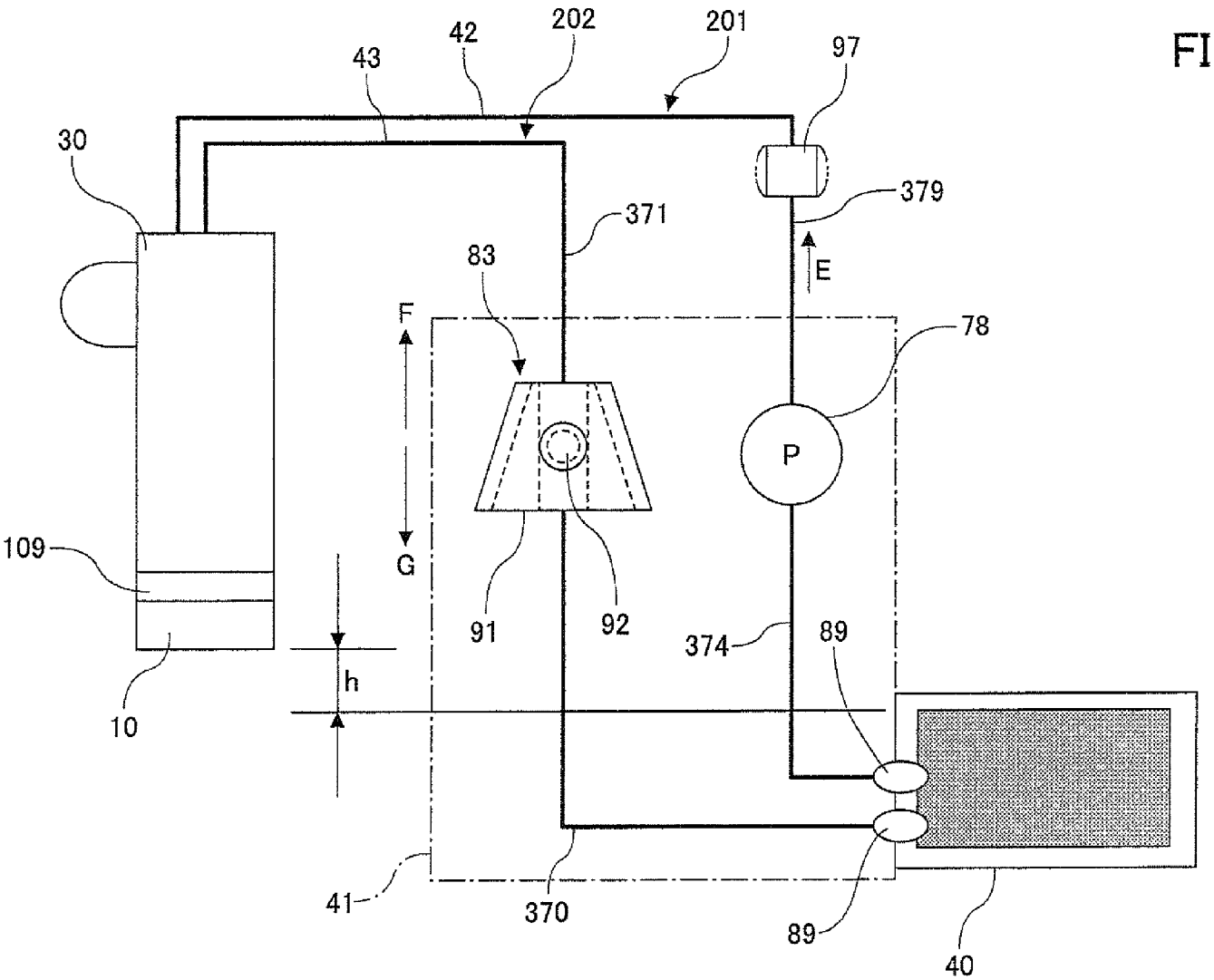
FIG. 26 is an explanatory diagram for explaining an outline of the ink supplying system according to a sixth embodiment of the present invention.

With reference to FIG. 26, a description is now made of the ink supplying system according to a sixth embodiment of the present invention.

This embodiment is a combination of the configurations of the third, fourth, and fifth embodiments. In other words, as shown in FIG. 16, the ink cartridge 40 has the bag member 93 provided with the compression spring and formed of a flexible material that can freely transform when the ink is consumed, and the ink is stored in the bag member 93. With this configuration, the ink cartridge 40 voluntarily generates a negative pressure. Therefore, the ink cartridge 40 can be arranged at a position higher than the nozzle surface of the recording head 10.

In this embodiment, the buffer member 97 is provided between the first tube 42 and the pump 78. With the buffer member 97, an unnecessary pressure pulse generated by the pump 78 can be attenuated, and a transitional pressure change when the pump 78 is started and stopped can be absorbed. As a result, the pressure of the recording head 10 can be more stabilized.

Note that in the above description, the operations and effects of the embodiments of the present invention are applied to a case in which the different colors of the ink are supplied to the plural heads, but they can also be applied to a case in which the same colors of the ink are supplied to the plural heads and a case in which the ink having different specifications are supplied to the plural heads. Furthermore, the operations and effects can also be applied to an ink supplying system in which different types of the liquids are ejected from one liquid ejection head having plural nozzle arrays. Moreover, the operations and effects can be applied not only to an image forming apparatus that ejects narrowly-defined ink but also to a liquid ejection apparatus that ejects various liquids.

The present application is based on Japanese Priority Applications No. 2008-225226 filed on Sep. 2, 2008 and No. 2009-151505 filed on Jun. 25, 2009 with the Japan Patent Office, the entire contents of which are hereby incorporated by reference.

The invention claimed is:

1. An image forming apparatus comprising:

a recording head that ejects a liquid droplet;

a liquid tank that stores ink to be supplied to the recording head;

a first flow path that is communicated with the recording head and the liquid tank;

a pump unit that is provided in the first flow path; and a second flow path that is provided parallel to a portion of the first flow path, such that the second flow path is branched from the first flow path in which the pump unit is provided a fluid path resistance variable unit that is provided in the second flow path and is configured to change a fluid resistance in the second flow path in accordance with a flow rate and a flow direction of liquid flowing through the second flow path and the fluid path resistance variable unit; wherein:

the fluid path resistance variable unit increases the fluid resistance in the second flow path when liquid is flowing towards the recording head through the fluid path resistance variable unit and decrease the fluid resistance in the second flow path when liquid is flowing away from the recording head through the fluid path resistance variable unit; and when the liquid droplet is ejected from the recording head, the pump unit operates to feed the liquid from the liquid tank to the recording head to increase the flow rate of the liquid flowing toward the recording head from the liquid tank through the second flow path.

2. The image forming apparatus according to claim 1, wherein the second flow path is communicated with the first flow path on both an upstream side and a downstream side of the pump unit in a liquid feeding direction and communicated with the liquid tank and the recording head via the first flow path.

3. The image forming apparatus according to claim 1, wherein the first flow path and the second flow path are communicated with the liquid tank and the recording head via different flow paths.

4. The image forming apparatus according to claim 3, wherein the fluid resistance of the first flow path is greater than the fluid resistance of the second flow path.

5. The image forming apparatus according to claim 3, wherein the pump unit generates a flow directing from the liquid tank to the recording head and a flow directing from the recording head to the liquid tank and circulates air inside at least any of the first flow path and the second flow path so as to be discharged into the liquid tank.

6. The image forming apparatus according to claim 1, wherein plural of the pump units are provided and driven by a common driving unit.

7. The image forming apparatus according to claim 1, wherein the fluid resistance control unit reduces the fluid resistance along with an increase in the flow rate of the liquid when the flow of the liquid is directed from the recording head to the liquid tank and makes the fluid resistance constant when the flow of the liquid is directed from the liquid tank to the recording head.

8. The image forming apparatus according to claim 1, wherein a liquid feeding amount by the pump unit is controlled based on a temperature of the liquid.

9. The image forming apparatus according to claim 1, wherein the liquid tank is communicated with atmosphere and arranged in such a manner that a liquid surface is positioned below a nozzle of the recording head in a gravity direction.

10. The image forming apparatus according to claim 1, wherein the liquid tank has a bag-like member formed of a flexible material and storing the liquid and is arranged below the nozzle of the recording head in the gravity direction.

11. The image forming apparatus according to claim 1, wherein the liquid tank is maintained at a pressure smaller than an atmospheric pressure.

12. The image forming apparatus according to claim 1, wherein a liquid supplying path composed of the first flow path and the second flow path is provided with a pressure change absorption unit that absorbs a pressure change of the liquid.

13. The image forming apparatus according to claim 1, wherein the fluid resistance control unit is integrated with the pump unit.

14. The image forming apparatus according to claim 1, wherein the pump unit and the fluid resistance control unit are disposed in the second flow path of liquid from the liquid tank to the recording head, and the apparatus does not have a return route of the liquid from the recording head to the liquid tank.

15. The image forming apparatus according to claim 1, wherein the fluid resistance control unit includes a valve disposed movably in a control flow path within the fluid resistance control unit to adjust flow resistance through the control flow path, and when the flow rate of the flowing liquid increases due to ink ejection from the recording head, the valve in the fluid resistance control unit is moved in a direction to increase fluid resistance.

* * * * *